US010319349B2

(12) United States Patent
Culver et al.

(10) Patent No.: US 10,319,349 B2
(45) Date of Patent: Jun. 11, 2019

(54) CONTOURED PICK AND A METHOD OF MULTIPLE VARIATIONS OF 3D CAD MODELS

(71) Applicants: Matthew A. Culver, Redding, CA (US); Patrick J. Tennant, Redding, CA (US); Mark Cooper, Redding, CA (US)

(72) Inventors: Matthew A. Culver, Redding, CA (US); Patrick J. Tennant, Redding, CA (US); Mark Cooper, Redding, CA (US)

( * ) Notice: Subject to any disclaimer, the term of this patent is extended or adjusted under 35 U.S.C. 154(b) by 656 days.

(21) Appl. No.: 13/998,186

(22) Filed: Oct. 8, 2013

(65) Prior Publication Data

US 2015/0096426 A1 Apr. 9, 2015

(51) Int. Cl.

| | |
|---|---|
| ***G10D 3/10*** | (2006.01) |
| ***G10D 3/16*** | (2006.01) |
| ***A43D 1/02*** | (2006.01) |

(52) U.S. Cl.

CPC ..... *G10D 3/163* (2013.01); *A43D 1/025* (2013.01)

(58) Field of Classification Search

CPC ..... G10D 3/163; G10D 1/005; B29C 2045/14532; B29C 39/025; B29C 39/10; B29C 45/14065; B29C 45/14336; B29C 45/14344; B29C 45/14467; B29C 45/1676

USPC ..... 84/320–322

See application file for complete search history.

(56) References Cited

U.S. PATENT DOCUMENTS

| | | | | |
|---|---|---|---|---|
| 2,016,438 | A * | 10/1935 | Kealoha | G10D 3/163 84/322 |
| 4,879,940 | A | 11/1989 | Pereira | |
| 5,323,677 | A | 6/1994 | Knutson | |
| 7,312,386 | B2 | 12/2007 | Sielaff | |
| 7,375,268 | B1 | 5/2008 | Thornhill | |
| 8,032,337 | B2 | 10/2011 | Deichmann et al. | |
| 8,378,193 | B2 | 2/2013 | Culver et al. | |
| 2012/0232857 | A1 | 9/2012 | Fisker et al. | |
| 2012/0305003 | A1 | 12/2012 | Mark | |

OTHER PUBLICATIONS

Author unknown, internet url "http://www.elderly.com/brand/PKFG_propik.html".

Author unknown, Alaska Pik (advertisement), Fingerstyle Guitar, May/Jun. 1998, p. 34, No. 27.

Author unknown, Coimbra pick, internet url "http://fernandezmusic.com/Portuguesemethodpage2.html".

Author unknown, Fred Kelly Freedom pick, internet url "http://fredkellypicks.com/".

Author unknown, Alaska pik, internet url "http://alaskapik.com/".

Jessica Leber, internet url "http://www.technologyreview.com/news/515536/can-infinite-variation-be-mass-produced-using-3-d-printing/".

(Continued)

*Primary Examiner* — Kimberly Lockett

(57) ABSTRACT

The original contoured thumb and finger pick for players of stringed instruments introduced an incredible innovation for guitar players and others. Improvements based on this unique concept have transformed a useful tool into an extremely comfortable and natural strumming aid. The pick saddle totally follows the thumb and finger contours for greater comfort and the band is secured to the pick with a low profile post.

8 Claims, 30 Drawing Sheets

(56) References Cited

OTHER PUBLICATIONS

Figure 1:
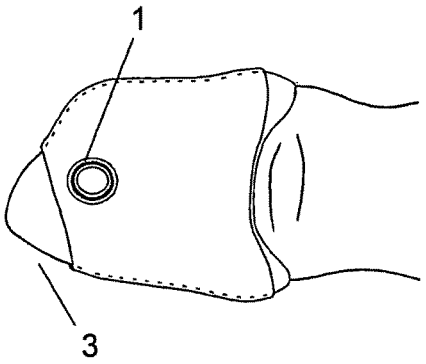

Author unknown, http://www.prnewswire.com/news-releases/shapeways-announces-infinite-possibilities-with-over-six-billion-product-variations-in-its-marketplace-169171186.html.
Butdee et.al, Formulation of 3D shoe sizes using scanning camera and CAD modelling, Journal of Achievements in Materials and Manufacturing Engineering, Dec. 2008, p. 449.
Andrew Liszewski, internet url "http://gizmodo.com/5990352/new-balance-adopts-3d-printing-to-create-hyper+customized-track-shoes".
Emma Hutchings, internet url "http://www.psfk.com/2013/04/3d-printed-instant-shoes.html".
Author unknown, internet url "http://www.3ders.org/articles/20120813-new-start-up-offers-3d-printed-glasses-fit-to-your-face.html".

* cited by examiner

Cancelled

Cancelled

CONTOURED PICK AND A METHOD OF MULTIPLE VARIATIONS OF 3D CAD MODELS

REFERENCES TO RELATED PRIOR ART

| Patent No. | Inventor | Reference Source |
|---|---|---|
| 8,378,193 | M. Culver et. al | USPTO |
| NA | Mark | USPTO, Pat. App. 20120305003 |
| NA | Fiskar | USPTO, Pat. App. 20120232857 |
| 8,032,337 | Deichmann et. al | USPTO |
| 7,375,268 | Thornhill | USPTO |
| 7,312,386 | Sielaff and Sielaff | USPTO |
| 5,323,677 | Knutson | USPTO |
| 4,843,942 | Ishizuka | USPTO |
| 4,879,940 | Pereira | USPTO |
| 3,739,681 | Dunlop | USPTO |
| NA | unknown | http://www.elderly.com/brand/PKFG_propik.html |
| NA | unknown | Alaska Pik (Advertisement) Fingerstyle Guitar, May/June 1998, No. 27, p. 34 |
| NA | unknown | Coimbra pick, fernandezmusic.com/Portuguesemethodpage2.html |
| NA | unknown | Fred Kelly Freedom Pick, www.fredkellypicks.com |
| NA | unknown | http://www.technologyreview.com/news/515536/can-infinite-variation-be-mass-produced-using-3-d-printing/ |
| NA | unknown | http://www.prnewswire.com/news-releases/shapeways-announces-infinite-possibilities-with-over-six-billion-product-variations-in-its-marketplace-169171186.html |
| NA | Butdee et. al | Journal of Achievements in Materials and Manufacturing Engineering, Vol. 31, December 2008 |
| NA | unknown | http://www.newbalance.com/New-Balance-Pushes-the-Limits-of-Innovation-with-3D- |
| NA | unknown | http://www.psfk.com/2013/04/3d-printed-instant-shoes.html |
| NA | unknown | http://www.3ders.org/articles/20120813-new-start-up-offers-3d-printed-glasses-fit-to-your-face.html |

BACKGROUND OF THE INVENTION

This invention falls into the category of strumming aids for persons who play stringed instruments and specifically to those aids that are worn upon the finger or thumb. This invention is an improvement upon an existing invention entitled "Contoured Finger Pick for Stringed Instruments", invented by Matthew A. Culver et al. and will be referred to as "the invention" or "this invention" throughout the remainder of this specification. The prior art upon which this invention is an improvement will be referred to as "prior art contoured pick". The prior art term "pick saddle" is the contoured pick without the elastic band which aids in securing the pick saddle to a finger or thumb. Said term is used in this specification in the same way.

In the prior art patent specification of the contoured pick Mr. Culver addresses six problems that his invention solves over previous prior art. The problems with existing finger and thumb picks are as follows:

(1) The pick causes discomfort after a few minutes of use.

(2) The pick interferes with the player's natural playing style.

(3) It requires the player to learn a new picking style.

(4) It slips from position while in use and requires frequent readjustment.

(5) It doesn't produce the desired sound of a conventional plectrum (6) Unwanted sounds are made when the user inadvertently touches an adjacent string.

In fact, the prior art contoured pick does solve these problems but introduces a few new problems. The problems with the prior art contoured pick are as follows:

(1) The band of the contoured pick covers too much of the fingertip and interferes with the playing of the instrument.

(2) There is not an adequate securing means of the band to the pick saddle.

(3) The abrupt corners on the upper surface of the pick flange as it attaches to the saddle inhibit the smooth playing of "backstrokes".

(4) On the picks for fingers, not thumbs, the saddle extends in a lateral direction too far over the side of the finger and causes noise if it contacts an adjacent string.

In addition to solving the problems with the prior art contoured pick this invention discloses three additional novel features. This invention discloses (1) a pick element and a modified lower saddle surface for the thumb pick to replace the pick flange, (2) a means of securing the band to the pick saddle, and (3) a special design feature which causes the pick saddle to be much more flexible, thus adding to the comfort of the pick.

SUMMARY

The object of this invention is to solve some problems with the prior art contoured pick which turn it from a useful and novel product into an amazing high performance strumming aid which will fit any persons finger or thumb and be just what he needs for the way that he plays. The elastic band has been slimmed down and is free from contacting strings. The top surface of the pick has been smoothed so a string does not catch on corners on backstrokes. The extra material on the sides of the finger pick has been eliminated to create a low profile so the playing experience is very clean and unobstructed. The flat flange of the contoured pick for the thumb has been replaced with a naturally curved undersurface which gently squeezes the underside of the thumb to keep the thumb surface snug against the pick. And the elastic band which holds the pick in place is secured to the top surface of the pick saddle by threading it through a post.

DESCRIPTION—MAIN EMBODIMENT

Figure 2:
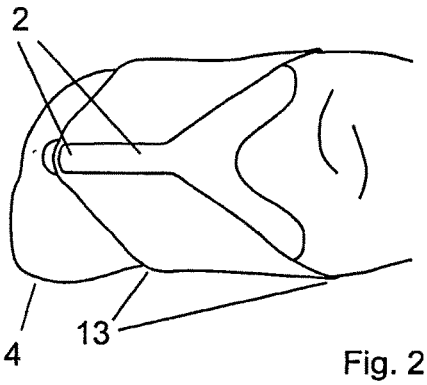
Figure 5:
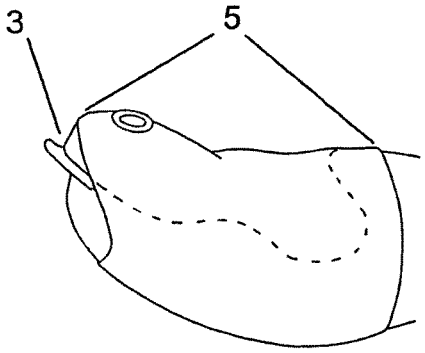
Figure 6:
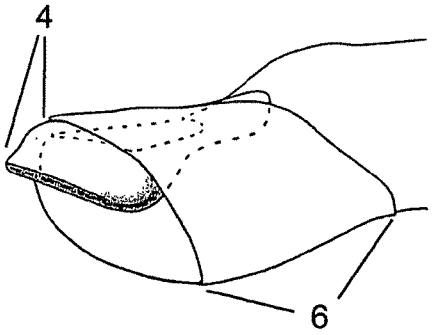

An improvement of the elastic band used to hold the pick in place on the finger involves decreasing the width so that more of the fingertip is uncovered. This allows unhindered movement of an instrument string across both lower and upper surfaces of the finger and the pick saddle. FIGS. 1 and 5 show a top view and side view respectively of the prior art "contoured pick" for a thumb. It can be seen that the band (5) covers much of the surface of the distal digit—so much so that only a small part of the fingertip is left uncovered. The distal digit is the part of a finger or thumb past the last joint and terminating at the tip of the finger or thumb. The original advantage of this particular design of the band was to maximize the securing of the saddle into it's position on the finger. After extensive testing it has been concluded that this is too excessive, and that this much use of the band is overdoing it. Feedback from other persons using this pick indicates that the band also tends to interfere with the free movement of the string across both the undersurface of the finger on a down stroke, and across the upper surface of the saddle on a back stroke. FIGS. 2 and 6 show a top view and a side view of the band of the improvement (6). These drawings show that nearly the entire fingertip area is now exposed with the improvement.

The securing means of the elastic band to the pick saddle is perhaps the weakest part of the entire design of the prior art contoured pick. The preferred embodiment of the prior art contoured pick uses an eyelet (1) near the fingertip area of the saddle to hold the elastic band in place on the saddle (see FIGS. 1 and 5). This is not an ideal solution for several reasons. Eyelets used to hold any elastic material don't work very well. The material tends to stretch itself to the point of pulling away, and this frequently occurs when the contoured pick is put in place on the finger. The band is stretched quite a lot to get the pick to seat properly and comfortably. Eyelets tend to introduce a high stress area on the elastic band so that it tears.

Another problem occurs when a band needs to be replaced because eyelets are difficult to remove. Also it requires the user to reinstall a new eyelet with each new band. It is anticipated that most potential users of the contoured pick will balk at having to do this each time the band needs to be replaced.

Figure 3:
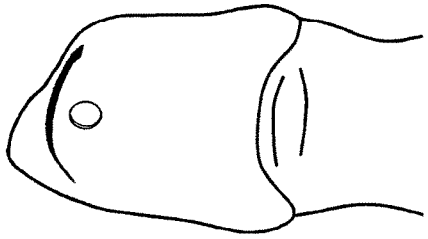
Figure 4:
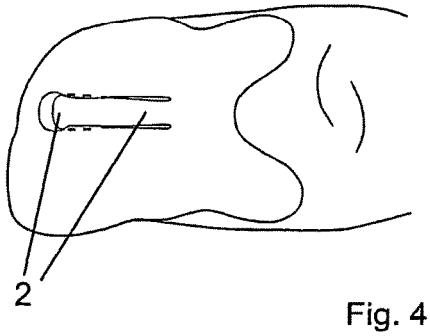

This invention introduces a new design which completely solves this problem with the securing of the band. The improvement to the contoured pick uses a securing "post" (2) which is essentially a "U" shaped groove carved into the upper surface of the pick saddle. FIG. 4 shows a top view of a thumb pick of this invention, with the elastic band omitted for clarity. FIG. 3 shows the same view of the prior art contoured pick, also without the band. The post in FIG. 4 can be seen at the center of the upper part of the pick saddle, mostly covering the fingernail area. FIGS. 2 and 6 show top and side views of the invention with the elastic band in in place by threading it through this post. This produces absolutely wonderful results.

Another problem mentioned by some using the prior art contoured pick occurs when the player does a "backstroke". Although players using finger picking as their preferred method of playing use mostly forward strokes, the majority of players hold a flat pick and play with both forward and back strokes. Those players would be more likely to use a finger pick if there was one that would always allow then to do both forward and back strokes in the same way a flat pick is used. The design of the prior art contoured pick does not work well with this style, and for a simple reason. The way in which the pick flange is attached to the saddle leaves an abrupt corner (3) on the top side of the pick, where a string traveling across this surface can easily catch on a backstroke. FIG. 5 shows this problem corner.

Figure 83:
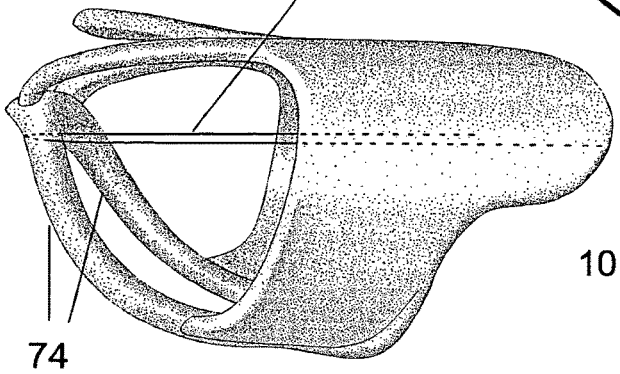
Figure 84:
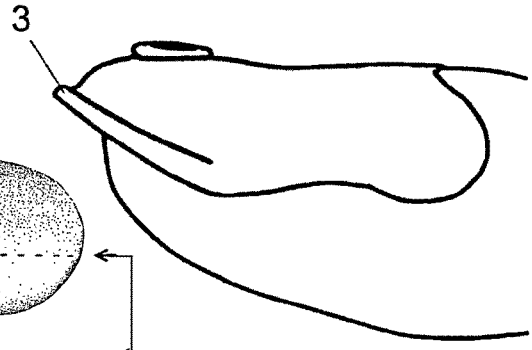
Figure 85:
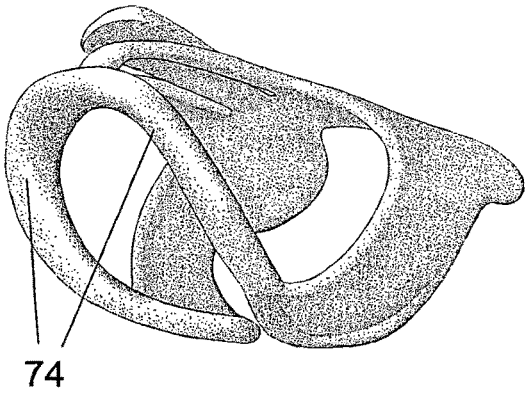
Figure 86:
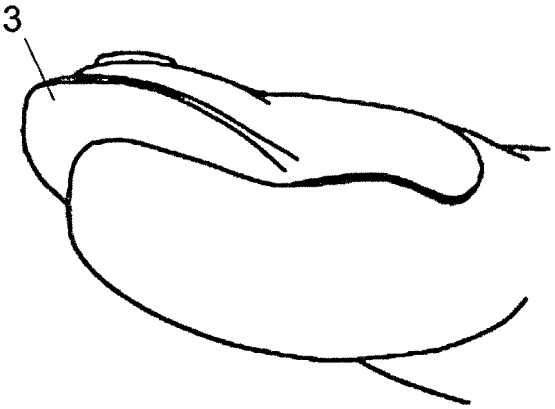

This invention provides the solution. The improvement eliminates the corner and provides a smooth continuous surface (4) over the upper part of the pick. This design change has been incorporated on both thumb and finger picks. This now allows forward and backstrokes to be played on all fingers with nothing impeding the movement of the pick across the strings. Another improvement to the prior art contoured pick has been done to enhance the performance of the finger pick. This improvement is the removal of much of the saddle surface near the fingertip as shown in FIGS. 83 and 85. FIGS. 84 and 86 are the same respective views of the contoured pick for comparison.

This concludes the description of this invention's solutions to the four problems of the contoured pick. This invention discloses two additional novel features which are also improvements to the contoured pick. First, this invention eliminates the "pick flange" (9) of the contoured pick which is essentially the entire lower surface of the contoured pick. This is a planar surface attached to the lower perimeter of the contoured portion (pick saddle).

Figure 17:
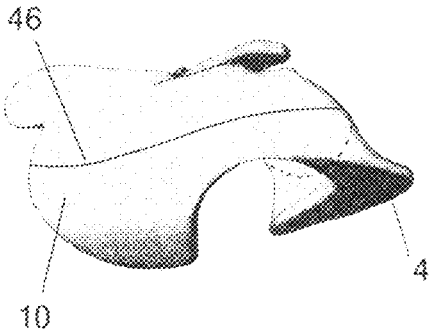
Figure 18:
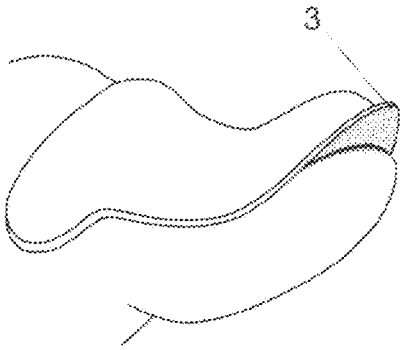

The pick flange is replaced with two elements, the first being an extension of the pick saddle extending past the upper (dorsal) part of the finger or thumb and covering a portion of the lower surface. This extension on the lower part of the saddle is called the encroachment surface (10) as shown in FIG. 17 fora thumb pick. In this drawing a line is shown called the encroachment boundary (46) which marks the upper boundary of this part of the modified pick saddle. FIG. 18 shows a similar view of the contoured pick for comparison. The second element of the improvement that replaces the pick flange of the contoured pick is called the pick element (11). This can be seen in FIG. 17 for a thumb pick and can be described as a thin protrusion from the lower inside tip of the pick saddle.

The improvement to the prior art contoured pick for fingers also incorporates the same encroachment surface (10) as the thumb pick with the saddle being extended past the upper surface of the finger and continuing partially onto the underside. FIG. 83 shows this feature and the encroachment curve (16) and FIG. 84 shows the prior art contoured pick for comparison.

Figure 87:
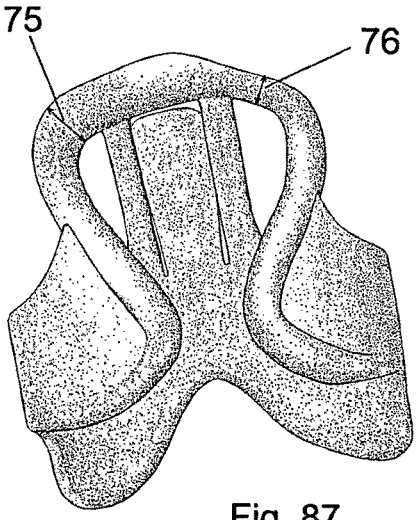
Figure 88:
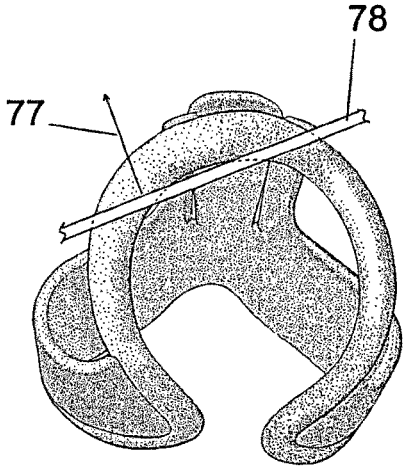

The pick element for the finger pick (74) has a different shape than the pick element for the thumb. FIGS. 83, 85, 87 and 88 show that the finger pick element is a somewhat oval shaped ring-like structure and extends from a lower proximal position on one side of the finger, traveling toward the fingertip along half of its oval path, rounding the tip and returning toward its termination on the lower proximal part of the other side of the finger. This is in comparison to the pick flange (3) of the contoured pick shown in FIGS. 84 and 86 which is a flat, thin sheet in a somewhat crescent shape attached to the lower distal surface of the pick saddle. A very important feature is the shape of the pick element. In FIGS. 87 and 88 it can be seen that the distal portion of the pick element varies in width between the right and left sides of the pick as seen in these perspectives, with the width on the left side (75) being greater than the right side (76). This makes the pick asymmetrical and has a specific functional purpose as will be disclosed later. All other prior art finger picks do not have this design feature. The second novel feature of this invention allows control of the flexibility of the saddle portion of this invention. This is accomplished by controlling the wall thickness of the pick saddle. Many materials can be used in the composition of the pick saddle (body) but the best results are obtained with materials that have some flexibility. Greater flexibility of any material is obtained with thinner wall thicknesses. This invention is currently manufactured of nylon-12 (polyamide 2200) using a 3d printing technology known as selective laser sintering (SLS). With SLS 3d printing as the method of manufacture the wall thicknesses are limited to somewhat less than 1 millimeter. It should be noted that any manufacturing process which can accommodate this wall thickness and lesser wall thicknesses can be used to manufacture the finger or thumb pick of this invention. Injection molding and 3d printing are two examples of such a manufacturing process.

This invention currently uses a wall thickness of less than 1 millimeter for most of the saddle portion of the pick body. As manufacturing materials and 3d printing processes improve it is anticipated that this invention will also be manufactured with even thinner walls in order to gain even greater flexibility.

Figure 19:
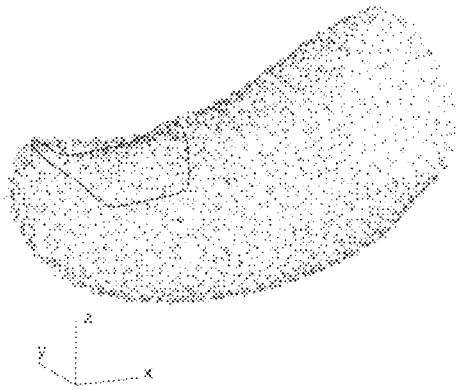

The construction of a contoured pick of this invention is done in four steps. The first step is the use of three dimensional (3D) scanning to generate a "likeness" of a thumb or finger surface. In the same way that a thumb or finger surface was used as a starting point for the contoured pick, this invention also starts with the same surface. The distal digit of a finger or thumb or a model thereof is scanned using a 3d laser scanner, although any optical scanning or contact device which will render a set of three-axis coordinate points that define the surface in three dimensional space will work. The result of the scanning is a collection of points as shown in FIG. 19, a single target point being defined by three distances, a single distance being measured along its corresponding single axis (x, y, or z axis) from the origin (0,0,0) to a single point on the single axis at which a plane perpendicular to the single axis intersects the target point.

In the following construction steps it's helpful to have some reference points within the virtual three dimensional space for working with 3D models. It is useful to put an origin, which is a point located at 0,0,0 on the xzy coordinate axes at the very tip of the finger or thumb surface. This point will also define the position of a longitudinal axis which will be a simple straight line that passes through the origin and continues lengthwise toward the middle of the base of the distal digit. In doing so, it is constructed so that it is as parallel as possible to the line of the fingernail or thumbnail when viewed from the side. See FIGS. 25 and 26.

Figure 20:
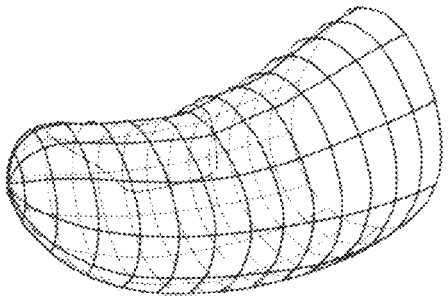
Figure 21:
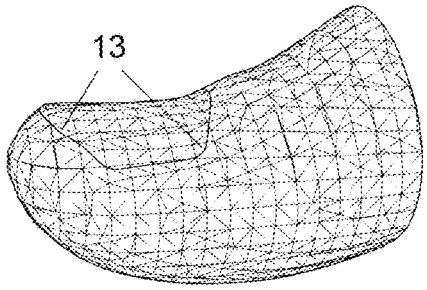

The second step in the construction of a contoured pick of this invention is to create a three dimensional virtual computer model of the pick saddle. This begins with the importation of the collection of points obtained from the first step into computer software known as three dimensional computer aided design software, or 3D CAD software. The collection of points is then used as input into a CAD software module which can create either a network of intersecting mathematical curves (FIG. 20) or a set of connected polygons (FIG. 21). Either of these resulting 3D CAD finger surfaces is used as the starting point to create a virtual solid model of this invention.

It should be mentioned at this point that an alternative to the $1^{st}$ step of this process up to the creation of a CAD finger or thumb surface described in the $2^{nd}$ step would be to use an existing CAD model of a human finger or thumb, many of which can be downloaded from various 3D CAD model repositories existing on the internet. The example which continues in the remainder of this description and the accompanying drawings are for a right handed thumb pick, and will use a thumb surface (12) consisting of a network of mathematical curves as shown in FIG. 20. A surface consisting of a network of curves is a series of longitudinal curves (13) that run in a longitudinal direction and define the shape of the surface in that direction, combined with lateral curves (14) that define the objects shape and are perpendicular to the longitudinal curves.

Following the creation of a three dimensional curve network of a thumb surface as described above, a curved line is drawn upon the upper surface of the thumb model which will define the perimeter of the invention on the upper side of the pick saddle. See FIG. 22. This line will be called the contour curve (15) and is shown as the solid curved line lying on the upper surface of the thumb model. A thumb nail (17) has been drawn on the surface for clarity of the drawing.

A second curved line is drawn which connects the ends of the contour curve and passes through the lower (lower) side of the thumb surface. This second line is called the encroachment curve (16) because instead of lying on the surface, it encroaches past the surface. It can be seen in FIG. 22 as the broken line extending beginning at the one end of the contour curve, then continuing past the lower surface of the thumb model and ending by joining with the other end of the contour curve. Three additional views of both of these curves can be seen in FIGS. 23, 24, and 25. It can be seen in the front views of both FIGS. 23 and 24 the path that the lower encroachment curve takes and that its encroachment in the vertical direction past the lower surface of the thumb is substantial.

Figure 26:
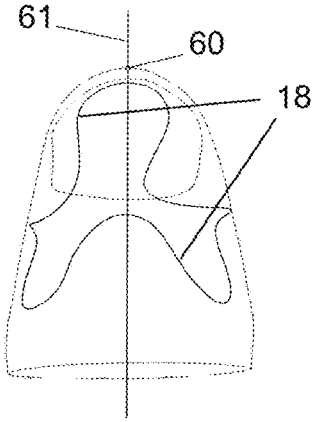
Figure 27:
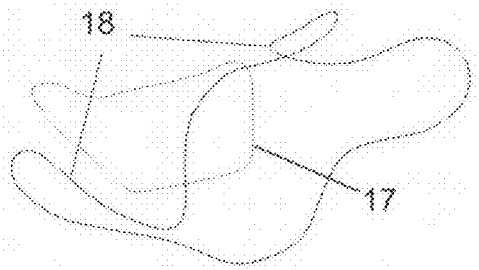
Figure 28:
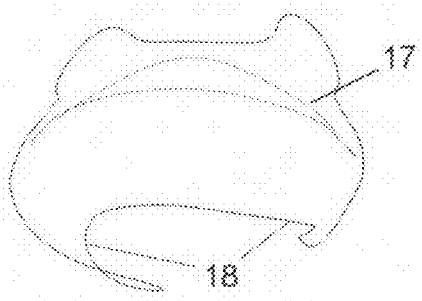

The contour curve and the lower encroachment curve are then connected to form one continuous closed curve, called the inner perimeter curve (18) shown in FIG. 26. FIGS. 27 and 28 show the inner perimeter curve without the thumb surface in two different views. An outline of the thumbnail is shown for clarity in all three of these drawings.

Figure 29:
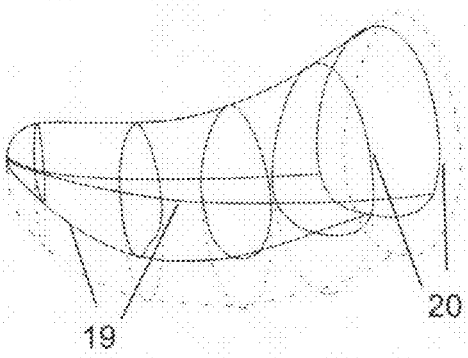
Figure 30:
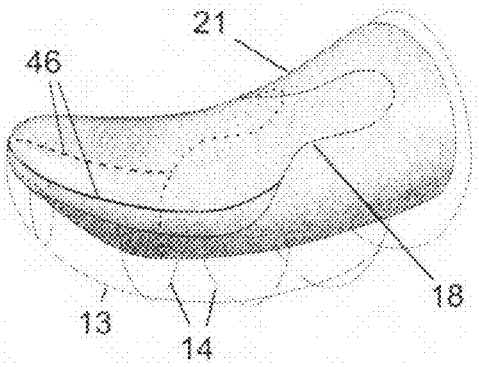

Then a modified thumb surface (21) is constructed (FIG. 30), beginning by redrawing the longitudinal and lateral curves of the original thumb surface. These modified longitudinal curves (19) and modified lateral curves (20) are drawn so that they intersect the inner perimeter curve, causing the modified thumb shape to conform to the outline of the inner perimeter curve. As these modified surface curves are drawn they begin at a line that runs longitudinally upon the original unmodified thumb surface called the upper encroachment boundary (46). The lateral curves are drawn so that they gradually depart from the original surface beginning from the upper encroachment boundary, make a smooth transition to where they end at the encroachment curve as shown in FIG. 30. FIG. 29 shows a greatly simplified drawing in which only four of the modified longitudinal lines and five of the modified lateral lines are shown. Five of the original lateral lines and the lower original longitudinal lines are also shown as dashed curves. Comparison of the original curves with the modified curves shows how the original thumb surface is trimmed on the underside to form the inner surface of the invention. In this drawing the inner perimeter curve has been omitted so that the modified surface curves can be clearly seen.

Figure 31:
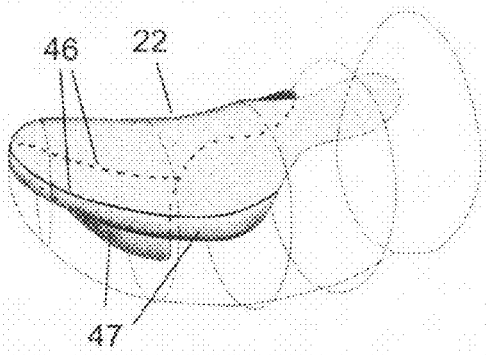
Figure 32:
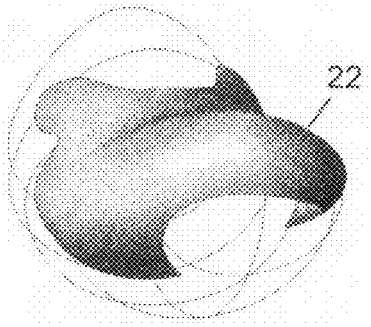
Figure 33:
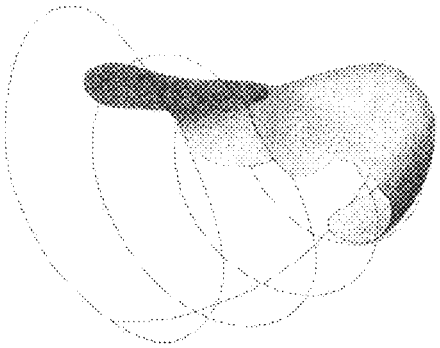

Then the modified thumb surface is formed from the modified longitudinal and lateral curves as shown in FIG. 30. The inner perimeter curve is again shown in this drawing, lying entirely upon the new modified surface. The inner saddle surface (22) is then created by trimming the modified thumb surface with the inner perimeter curve as shown in FIG. 31. This surface will be the inner surface of the finished pick model. The portion of the inner surface below the upper encroachment boundary is called the encroachment surface (10). A few of the original lateral curves and the lower longitudinal curve of the original thumb surface is shown for comparison, just as in FIGS. 29 and 30. FIGS. 32 and 33 show alternate views of the inner saddle surface, also with a few of the original curves shown for clarity.

Figure 34:
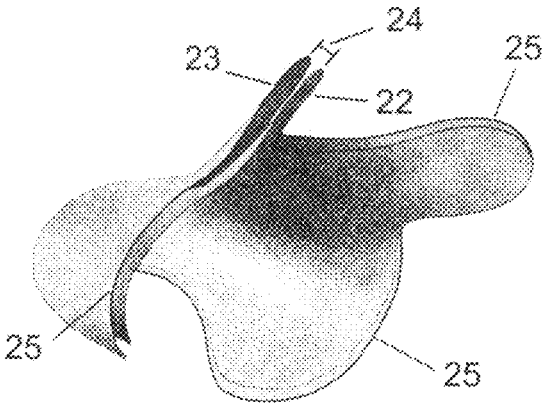

A second saddle surface, called the outer saddle surface (23), is then created by offsetting the inner saddle surface (FIG. 34). This is a common function in 3D CAD programs so that creating the offset surface involves no more than specifying the direction and the distance of the offset. The actual function of the offset creates a second surface in such a way that each point of the offset surface corresponds to an origination point on the input surface so that a line drawn between the two points is normal (perpendicular) to each surface at the point of its intersection with both surfaces. The offset distance (24) determines the wall thickness of the pick saddle, the approximate dimensions of which have been described earlier.

It should be noted that in nearly all of the drawings depicting this invention there are very few dimensions given. The reason for this is the nature of the object of this invention. As it has been formed based on the shape of a human anatomical part it is known in the world of 3D CAD modeling as a free form shape, and this type of CAD modeling is known as free form modeling. This is in comparison to parametric modeling of which all machined items can be categorized. With free form modeling there are no straight lines of specific lengths, angles of a specific degree, screw threads or circular diameters which can be identified and measured. The only sense of size and proportion can be gained by an awareness of what a thumb, finger, hand, or foot looks like, and the approximate size and range of sizes of these known entities can have. Free form shapes occur routinely in nature, however, nearly all man-made items have a parametric design with the exception of this invention.

Figure 35:
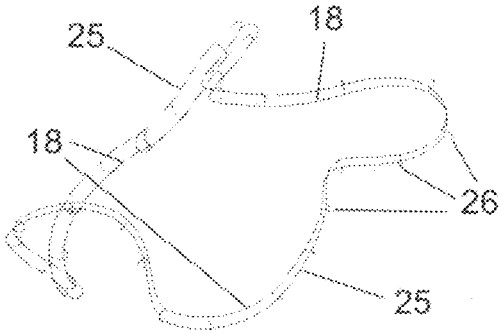
Figure 36:
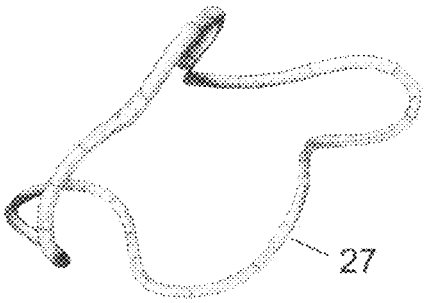
Figure 37:
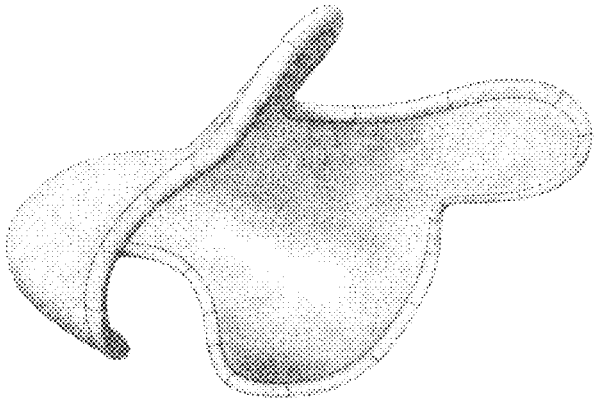

At this point an inner surface and an outer surface have been created, using the original thumb surface which was modified to fit the outline of the inner perimeter curve. Next an outer perimeter curve (25) is formed from the perimeter of the outer surface as shown in FIG. 34, and a number of perimeter connecting strip lateral curves (26) are drawn to define the lateral curvature of the perimeter connecting strip (27) as shown in FIG. 35. Then the perimeter connecting strip is created from the inner and outer perimeter curves and the corresponding lateral curves. This ribbon-like surface is shown in FIG. 36. Then the saddle inner and outer surfaces and the perimeter connecting strip are joined together to form a closed volume (FIG. 37). This closed volume in the world of three dimensional CAD models is called a solid. This enclosed volume is the basic unmodified pick saddle of this invention, which in combination with an elastic band would constitute one embodiment of this invention.

Figure 38:
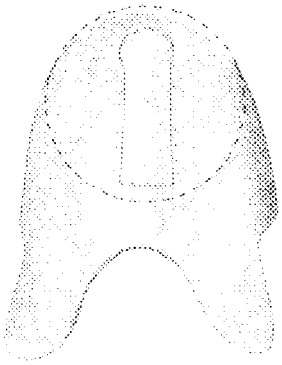
Figure 39:
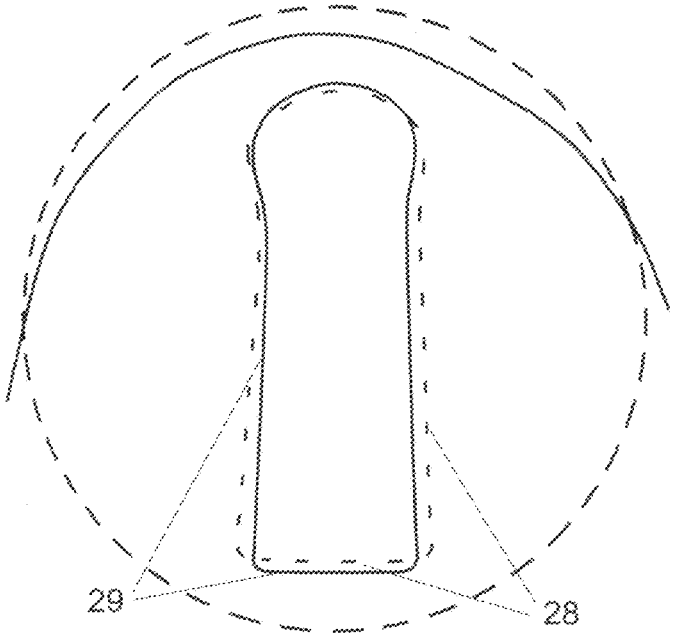
Figure 40:
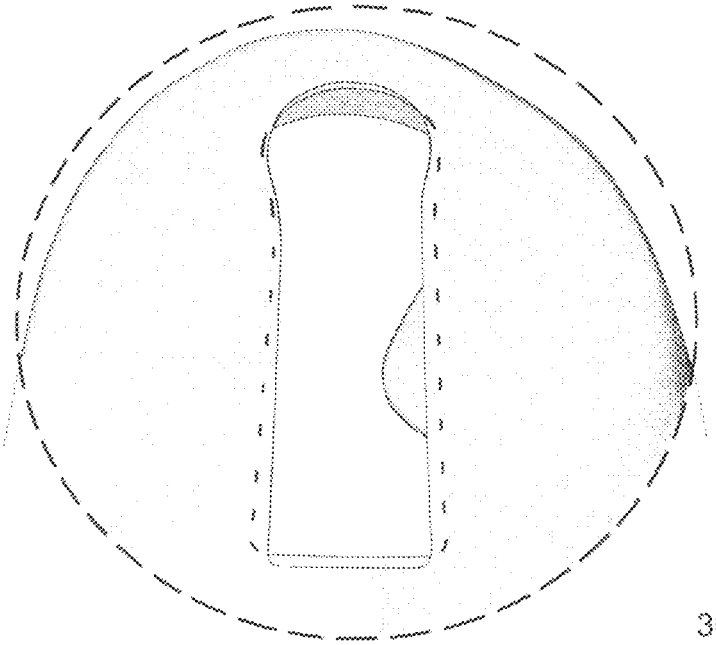

The solid shown in FIG. 37 is the pick saddle without a pick element (FIG. 57), and without the post which secures the elastic band to the pick saddle. The post is formed by first drawing two elongated somewhat rectangular shapes with rounded corners into both the inner shell and the outer shell as shown in FIGS. 38 and 39. These closed curves are called the inner post inset curve (28) and the outer post inset curve (29). It's important that the two short ends of the inner post inset curve are slightly longer than the same short ends of the outer post inset curve. The inner and outer shells are then cut with their respective post inset curves and the cut out shapes within the two cuts are saved for later use. These two cut out shapes are the upper post cut out (30), and the lower post cut out (31). The close up drawing of the top of the saddle following the post perimeter cutting operation is shown in FIG. 40. The two recesses that are formed as a result are called the lower post inset and the upper post inset.

Figure 41:
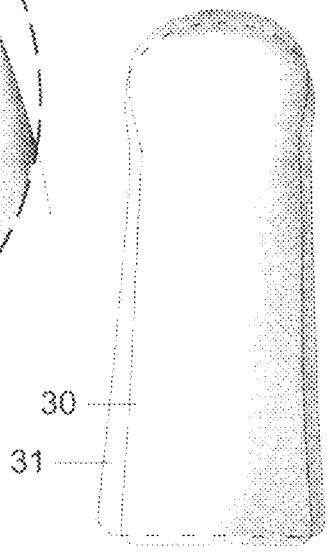
Figure 42:
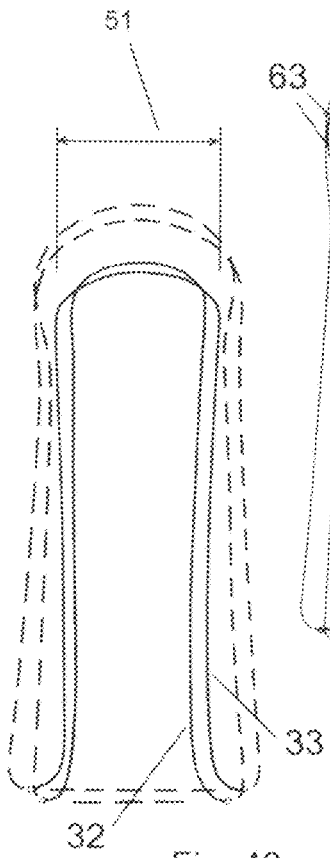

The upper and lower post cut outs are shown in FIG. 41. The post is formed beginning by drawing the desired shape on the surface of the post cut outs. The shape curves, called the upper post perimeter (32) and lower post perimeter (33), are shown in FIG. 42 and lie on the surfaces of the two cut outs. Then the two curves are used to trim the two cut outs and the trimmed area is discarded leaving the two shapes shown in FIG. 43, called the post upper (34) and the post lower (35). The upper post perimeter and lower post perimeter curves are shown in FIG. 42 as the solid lines, while the post inset curves are shown also to give perspective to the drawings. FIG. 44 shows the same surfaces but tilted at a better viewing angle and also shows the post inset curves for perspective.

Figure 45:
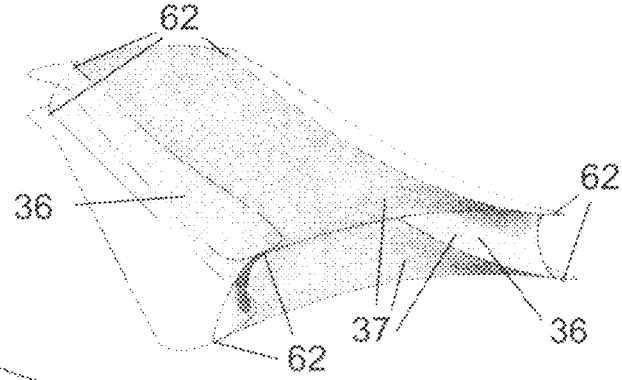

In the same way that the perimeter connecting strip was formed to join the saddle inner and outer surfaces, a post connecting strip (36) is formed to join the post upper and post lower and creating the post (37) shown in FIG. 45.

Figure 43:
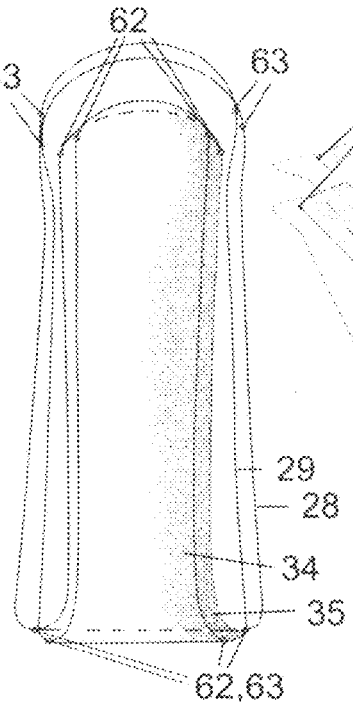
Figure 44:
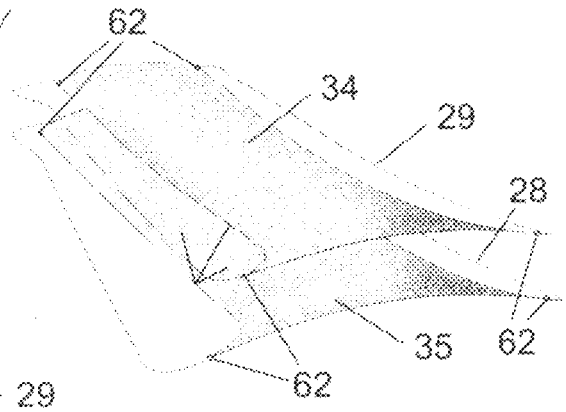

FIGS. 43, 44, and 45, also show sets of points on the upper and lower post perimeter curves which define the boundaries of the post longitudinal walls (56). These points are called the proximal post boundary points (62) and distal post boundary points. The post longitudinal walls are a portion of the post connecting strip which run nearly the whole length of the post. It can be seen in the drawings that the proximal boundary of the post longitudinal walls is at the base of the post and the distal boundary is near the end of the post where the curves leave the longitudinal direction and follow the semi-oval end of the post upper and post lower. These longitudinal walls will be used later to explain an important feature of the post and post inset.

Figure 46:
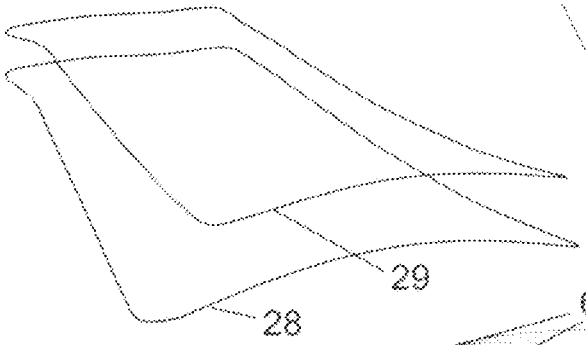
Figure 47:
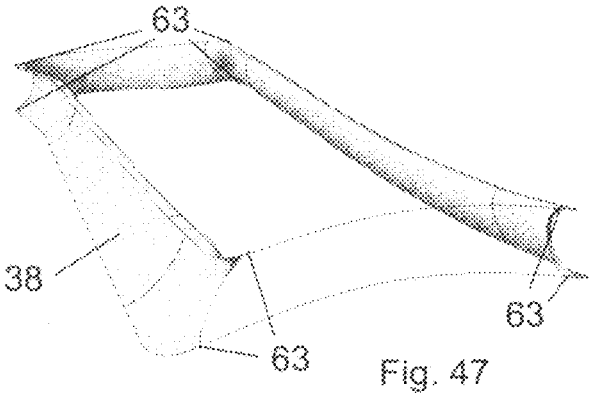
Figure 48:
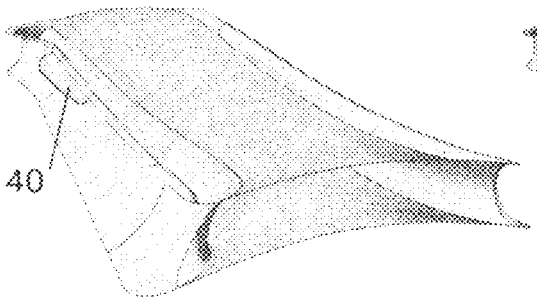
Figure 49:
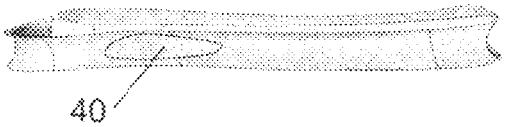
Figure 50:
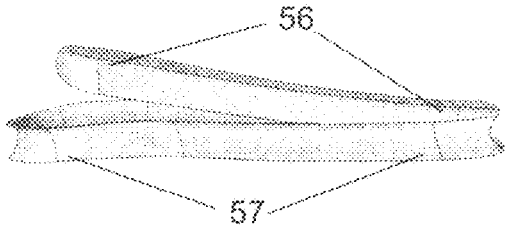

Then the post inset connecting strip (38) is created using the post inset curves (FIG. 46) as the boundaries for the length of the strip as shown in FIG. 47. When the post inset connecting strip is joined with the post it forms an object which will fit neatly within the cavities of the upper and lower post insets (FIG. 48). This object is the post assembly (39). Then joining the post assembly with the saddle completes the entire saddle assembly. Before that happens one other operation needs to be done. The walls of the post actually overlap (40) the walls of the post inset connecting strip. If the completed object was submitted to the controlling software of a 3d printer or any other computerized manufacturing tool it would either be rejected or be useless because the object would be fused together at this point. The solution for this is either to bend the post upward or downward, and the solution of this invention is to bend it upward. FIG. 49 shows a side view of the post assembly as originally formed and FIG. 50 shows the assembly after the post has been tilted upward from its base.

FIGS. 43 and 47 show proximal post inset boundary points (63) and distal post inset boundary points (65) on the upper and lower post inset curves which mark the boundaries of the post inset longitudinal walls (57). These walls are a portion of the post inset connecting strip. These walls in conjunction with the post longitudinal walls will be used later to explain an important novel feature of the post and post inset.

Figure 51:
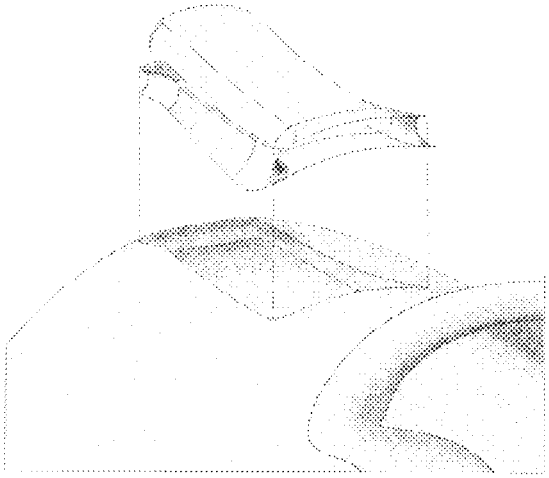
Figure 52:
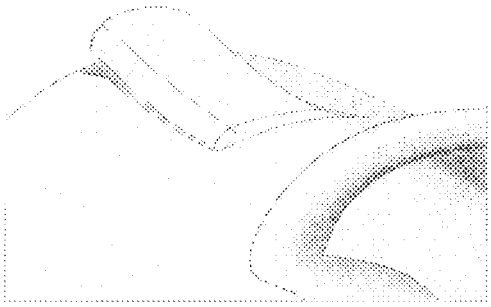
Figure 53:
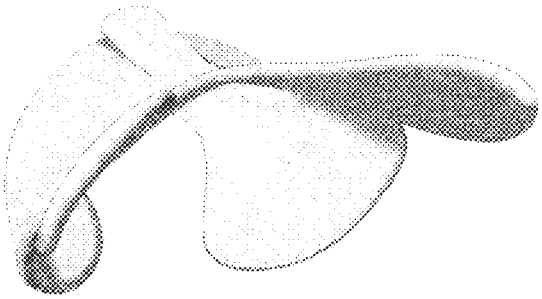

Now the finished post assembly can be inserted into the post inset cavities on the surface of the saddle as shown in FIGS. 51 and 52. A view of the entire pick saddle with post assembly is shown in FIG. 53. This completes the construction of the 2nd embodiment of a pick saddle of this invention. Additional embodiments can be created with the construction of a pick element.

Figure 54:
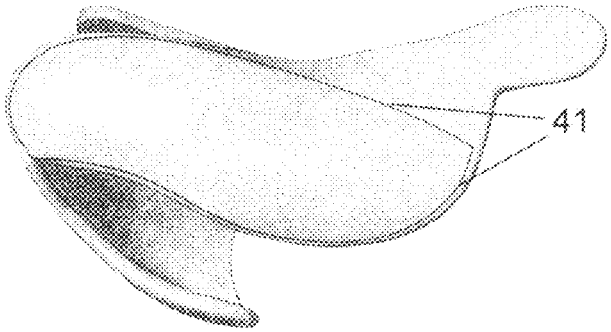
Figure 55:
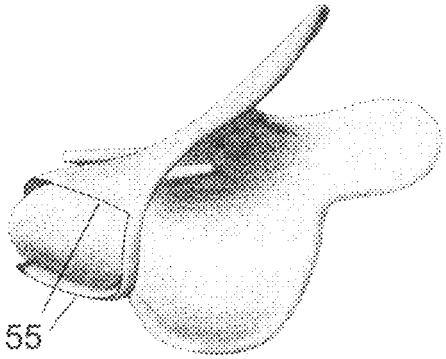

This begins by selecting a segment of the outer perimeter curve which will define the lower boundary of the pick element on the outer saddle, and then drawing an additional curve upon the upper left portion (for a right hand thumb) of the outer saddle surface. These two curves when joined together will form a closed curve called the pick element inset curve (41) as shown in FIG. 54, and will form the boundary of a cavity which will be cut into the outer saddle surface using the pick element inset curve. The edge of this cavity is the pick element inset edge (55). FIG. 55 shows a lower rear view of the saddle following the cut with the pick element inset curve.

Figure 56:
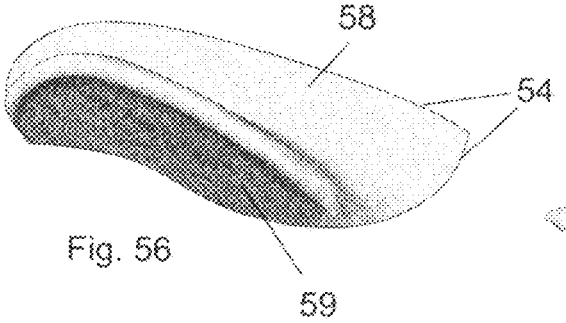
Figure 57:
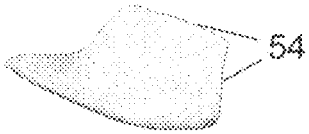
Figure 58:
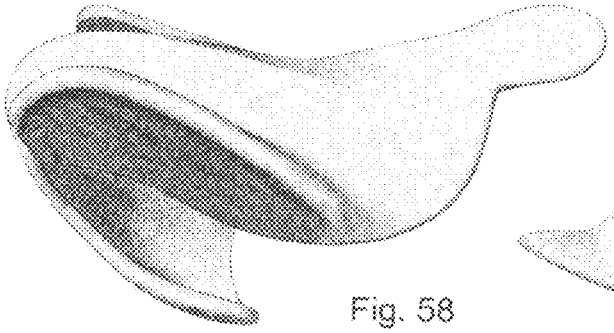
Figure 59:
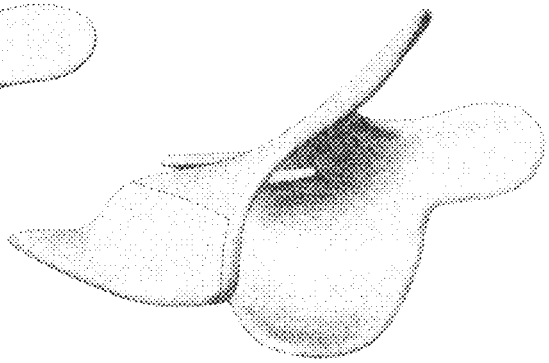
Figure 60:
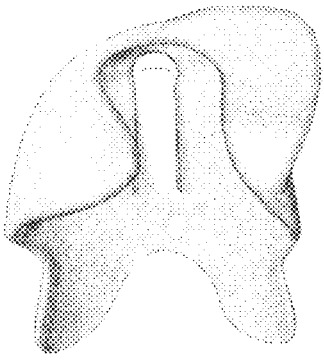

A pick element surface, FIG. 56, is constructed having an upper surface (58) and a lower surface (59), the outer edge of its surface matching the cut away area on the saddle surface. This edge of the pick element which will connect to the outer surface of the pick saddle is called the pick element connecting edge (54). It's important to note that the curvature of the pick element surface at the pick element inset edge (55) is such that this part of the element surface is tangent to the outer surface. This is done so that there is a seamless transition between the junction of the pick element and the outer surface of the pick saddle as shown in FIG. 59. (Two views of the pick element are shown in FIGS. 56 and 57, each view corresponding to the view just above it (FIGS. 54 and 55) showing where it would be attached to the saddle. The pick saddle undergoes another change to create the preferred embodiment of this invention. This is done by attaching the pick element to the saddle at the edges of the cavity. The two views, FIGS. 58 and 59 correspond to the same views of FIGS. 54-57, and another view is shown in FIG. 60.

The pick saddle now is complete and is a completely enclosed volume. This final 3D CAD model is in a form acceptable to be manufactured by any method which accepts 3D CAD models as input, which could be a 3D printer. This would be the third step in the construction of a contoured pick of this invention.

The fourth step in the creation of a contoured pick of this invention is the creation of an elastic band which is used to hold the pick saddle in place on the thumb or finger. This is of a shape similar to FIGS. 61 and 62. The portion of minimum width of the band at the top presents a low profile to the instrument strings while the pick is being used to play the instrument. The portion of maximum width of the band at the bottom creates a large surface area in which the band contacts the finger or thumb. In general, a larger area contacting the finger surface allows less constricting force necessary to keep the pick in place, and results in greater comfort for the user.

Figure 63:
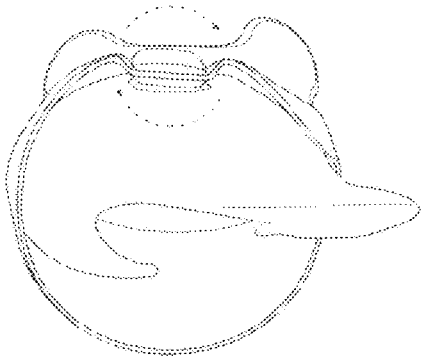
Figure 64:
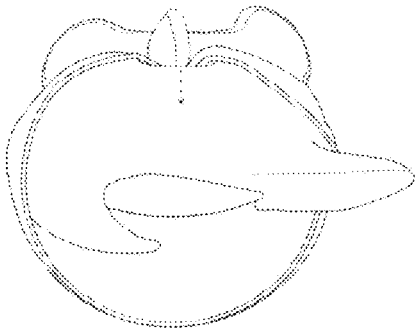
Figure 65:
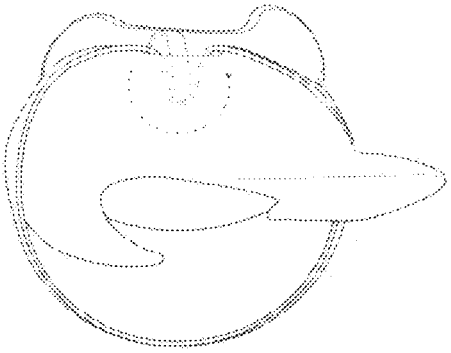

The band is installed onto the post of the saddle by passing the narrow part under the post as shown in FIG. 63. Then the post is twisted along its longitudinal axis as shown in FIG. 64 and pushed below the surface of the saddle as shown in FIG. 65. Then the post naturally rotates back to its original position as in FIG. 66 and the band is held securely in place against the post and the edges of the post inset. A view of the pick and band in place on a right hand thumb is shown in FIG. 67.

Now is a good time to introduce a concept which makes it easier to understand the relation between the surface of a human body part and the corresponding surface of a personal item made to "custom fit" the body part. In the case of the thumb and finger picks of this specification, this would be the interior surface of the pick and the surface of the thumb or finger. It was stated earlier that the process of constructing a pick saddle for a thumb pick begins with a thumb model. The thumb model then undergoes a modification in which it is altered so that the resultant pick will fit snugly and properly and perform well. So the resultant item made for the thumb does not have the exact surface of the thumb from which it is made. But the interior surface of the pick saddle is perfect for the surface of the original thumb. They are a perfect match. Although the actual surfaces don't match, the pair is a match. A perfect analogy to this comes from an earlier time when a shoemaker would make a shoe last of a customer's foot which is a wooden model of the customer's foot. The model would then be used to form the leather part of the shoe, conforming to the shoe last. The shoe last was not an exact model of the foot because every surface detail wasn't required to make the shoe fit well—surface details like the space between the toes, the ball of the foot, and various bone protrusions are not necessary to form the shoe. One way to express the concept that the surface of a body part and the interior or contacting surface of the item made for the body part match is to attribute another quality to the original surface. This quality is called the functional surface. The functional surface of the original thumb model used to construct the pick saddle is the modified thumb model. So the use of the term functional surface requires an understanding of three models and not just a pair of models. The three models are the original surface, the modified surface, and the interior surface of the final item made for the original surface. The modified surface is the link between the two and is why it is called the functional surface.

OPERATION—MAIN EMBODIMENT

The improvements to the prior art contoured pick have already been described. The improvements have increased the performance and comfort of the original to such an extent that the improved version is an entirely different device than the original contoured finger pick. The improvement has taken the basic novel concepts of the original and built upon them. The contoured shape of the upper part of the saddle is still retained by the improvement, and now the pick has a totally natural shape which integrates seamlessly with any persons finger or thumb to produce a playing experience that has not existed before now.

It was stated earlier that this invention replaces the pick flange of the contoured pick with an encroachment surface and a pick element. This invention creates a more comfortable compression of the lower surface of both the thumb and finger. As described in the specification of the prior art contoured pick, compression of the lower surface of the pick with the thumb or finger is necessary to keep instrument strings from catching on the lower edge. An underside view of a thumb pick of both the prior art contoured pick and this invention can be seen in FIGS. 17 and 18 respectively. The prior art contoured pick (FIG. 18) accomplishes the compression with a flat flange which essentially encroaches against the lower surface of the thumb. The problem with this is the compressive force of the flange is not equally distributed across its area of contact with the thumb, with more of the force occurring toward the center of its edge and less at the corners where the flange meets the pick saddle. This is okay for short playing times (30 minutes or less) without causing discomfort. But it's not a natural solution. The encroachment surface of this invention however follows the curvature of the thumb as it gently squeezes the thumb evenly throughout the entire surface of the pick saddle. This even distribution of pressure causes the pick to be much more comfortable and requires less force from the elastic band to get the necessary snug fit required to make the pick work. This is the primary advantage of this invention, that it distributes the force required to effectively hold it in place over a large area, and distributes more of the force to the less sensitive underside of the finger or thumb.

Replacement of the flange of the contoured pick for the thumb also requires a replacement of the part of the pick saddle which plucks or strums the strings, as the pick flange does for the prior art contoured pick. This invention uses a pick element which is essentially a portion of the encroachment surface which incorporates the piece that strikes the strings. The pick element for the thumb can be seen in FIG. 17 with additional views of the construction of the pick element and its integration with the encroachment surface in FIGS. 56-60. Visual comparison of the complete saddle of this invention with that of the prior art contoured pick can be seen in FIG. 17 and FIG. 18 respectively. Additional comparison of the contoured pick with other views of the improvement in FIGS. 58, 59, and 60 shows the improvement to be much more natural and free flowing, and this is not only in appearance but also in the comfort and playing.

The same design strategy appears in the pick for the fingers, although it takes a different shape because fingers do not have the shape and orientation as thumbs, and are used in a much different way when plucking strings. The finger pick shown in FIGS. 83, 85, 87, and 88 has been formed in the same way as the thumb pick, using a natural finger surface that has been modified with an encroaching undersurface. As stated previously, this gradual squeezing of the finger as the pick saddle extends from the upper surface to the lower surface causes the lower fleshy part of the finger to be pushed snugly against the edge of the pick.

The most obvious difference from the thumb pick is the large open area near the fingertip region on both sides of the finger. This portion of the pick saddle has been removed so that there is no hard material to bump into nearby strings when playing an instrument. If a soft finger does happen to contact an adjacent string it makes much less noise than the hard surface of the pick.

The second most noticeable difference from the thumb pick is the shape of the pick element. The pick element is substantially annular in shape but obviously, not perfectly ring shaped or even perfectly symmetrical. FIGS. 87 and 88 shows the asymmetry of the pick element along the longitudinal axis, the ring being smaller on the right side of the drawings, then larger in diameter and flatter toward the tip and proceeding downward as seen on the left part of the drawing. The larger part of the ring occurs where the string (78) contacts the pick element and is oriented so that the larger curved portion is substantially perpendicular to the path of the string (77) across the surface of the finger and pick element as shown in FIG.

88.

It must be noted that the annular and somewhat oval shape of the pick element and its placement on the underside of the finger is not in itself a new idea. Several existing prior art finger picks have this shape including the ProPik Fingertone, Dadi finger pick, Fred Kelly Freedom pick, and the Alaska Pik. The novel aspect of the pick element of this invention is its asymmetrical geometry. All of the aforementioned prior art fingerpicks are perfectly symmetrical along the longitudinal axis of a finger or thumb.

The asymmetry of both the finger and thumb picks of this invention takes advantage of the dynamics of the way strings move across the lower surface of the finger or thumb. As seen in FIG. 88 the direction of string travel is at a slight angle to the longitudinal axis, and the larger part of the pick element causes this part to protrude slightly above the surrounding surface of the finger so that as the string is plucked it is released from the surface of the pick element instead of the surface of the finger, creating the desired sound. The smaller portion of the pick element not close to the path of the string is partially hidden from contacting any strings because it is pushed into the surrounding finger surface, creating a lower profile.

For a symmetrical shape to accomplish the same thing the direction of the string travel would have to be parallel to the longitudinal axis, which it is not. The only advantage of a symmetrical design of such a pick element is that it can be used for both right and left handed players, where the pick element of this invention requires one asymmetrical model for right handed players and a mirror image of the model for left handed players.

The asymmetrical design of this invention is so critical that it could not function as intended at all if the pick did not have these features. Two of the design features which create this needed asymmetry are (1) the placement of the pick element for both the thumb pick and the finger pick, and (2) the shape of the encroachment curve of the thumb pick which defines the shape of the pick saddle on the lower surface of the thumb. Both of these features allow for the optimum placement of the pick element at the point on the thumb or finger where the finger or thumb most naturally contacts the string or strings to be plucked or strummed.

It is most important to note that no other finger or thumb pick has ever been designed specifically to be asymmetrical as a matter of necessity for it to take advantage of the way that instrument strings are naturally plucked or strummed. All prior art fingerpicks and thumb picks have been designed to be symmetrical, if not perfectly symmetrical, then what I call "functionally" symmetrical, or having functional symmetry. The functionally symmetrical design allows the pick to be worn on either the right hand or left hand simply by reversing the direction in which the pick is placed on the finger or thumb. This invention absolutely requires that a pick created for a right thumb or finger be used on the right finger or thumb, and could be said to have no functional symmetry by the definition given above.

There are two likely reasons for the symmetrical design of all prior art finger and thumb picks. First, before 3d printing, when nearly all such products had been made by injection molding (and still are), the cost of creating additional injection molds has been prohibitive. Also there are some objects which, although would otherwise be manufactured by injection molding, are not, because their design would not allow the part to be easily removed from the mold. This is not a problem at all with the 3d printing method of manufacture.

The second reason is that most people who design inventions that solve problems think in a completely different way than those that create free form objects like art and jewelry. Analytical problem solvers, of which I believe are most of the inventors of prior art picks, think in terms of parametric solutions. That is, the starting point of the invention is a well known common shape which is modified by integrating other common shapes. In this case the starting point for a finger pick would probably be a cylinder which would be something that could fit onto a finger or thumb. Parametric modeling and those who create objects using parametric modeling CAD software usually end up with solutions that are symmetrical. For example, most functional household items are symmetrical, including tables, chairs, bottles, suitcases, phones, fasteners, most electronic consumer items, cars, appliances, etc. These all have been designed with parametric modeling and have a very obvious symmetry. This type of design is easy to construct and goes quickly. A pick for plucking or strumming stringed musical instruments would be easy to create using this type of design, and incorporating symmetry would allow the device to be worn on a distal digit of either a left or right hand. It is worth mentioning that no such prior art pick exists that is made exclusively to be worn on a distal digit of a right hand or exclusively worn on one of the left hand. This invention is the first.

A major improvement to the prior art contoured pick is the means of securing the elastic band to the pick saddle. This is important for the band to stay in place on the surface of the saddle and provide the force necessary to hold the pick in place. The post replaces the eyelet featured in the prior art contoured pick, to the extent that this invention is superior, both in appearance and in performance.

The post is much stronger, and because it is larger than the eyelet it provides a larger area of contact of the band with the edges of the groove and post, and less force is required to hold the band in place. This greatly reduces the possibility of the elastic tearing. Although the post is larger than an eyelet, it has a much lower profile on the upper surface and does not interfere at all with string travel across the saddle on a backstroke. Another advantage is the band is much easier to replace. A new band is simply threaded around the post and it's done. The post also allows the band to be placed further away from the fingertip region which allows a band of much narrower width to be used.

Figure 76:
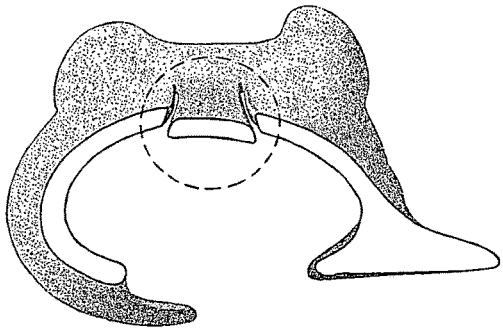
Figure 78:
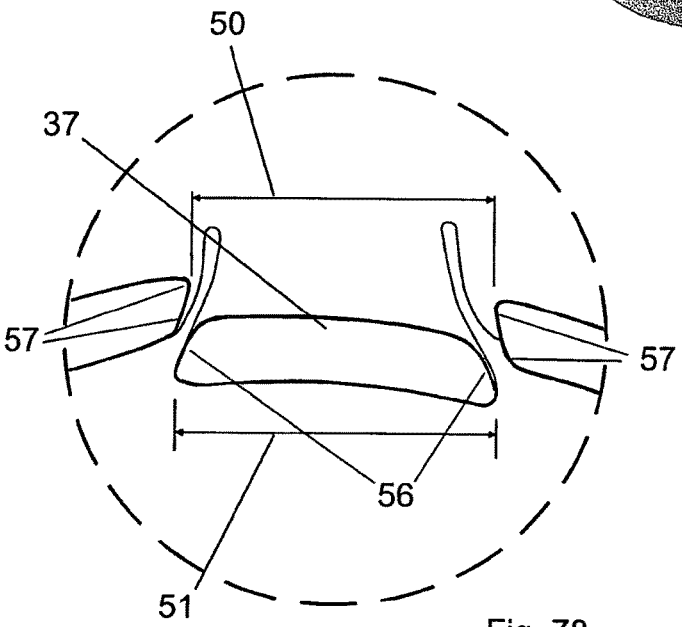

In holding the band securely against the pick saddle the post is subjected to forces exerted by the elastic band which tend to pull the post upward as the saddle and band are held in place on the thumb or finger. To prevent this from happening a key feature of the post is disclosed. This feature is its shape, first as it can be seen from a cross-sectional slice in a front view of the pick as in FIGS. 76 and 78, and second, as it can be seen in a top, or overhead view as in FIGS. 42 and 43. FIG. 76 shows a front view cross-sectional slice near the distal end of the post and at a point where the width of the post reaches its maximum, called the maximum width (51) of the post. FIG. 78 is a close up view of the same showing the post (37) at its maximum width. It can be seen that the cross-sectional shape of the post is somewhat like a trapezoid with rounded corners, and that the distance between the two opposing post longitudinal walls (56) at this cross-sectional slice are nearly the same as the minimum width (50) of the opening created by the opposing post inset longitudinal walls (57) at the top of the inset. When the band is inserted, the larger width of the post plus the thickness of the band itself create a greater width than that of the post inset walls and keep the band from pulling the post upward during use. With the post slightly below the surface the band is held tightly between the walls of the post and inset and also keeps the post out of the way of adjacent strings when playing.

The unique shape of the post can also be seen in FIGS. 42 and 43 where it is apparent that the width of the post along the longitudinal axis is greater near the distal end of the post close to the fingertip, reaching the maximum width as shown also in FIG. 42. At the proximal end near the base of the post the reverse is true. The more narrow width of the post near the base allows enough room for the post to be twisted when the band is installed so that the band and post together can be pushed through the narrower opening of the post inset at the distal end. FIGS. 63 through 66 show the installation sequence of the band. The combination of the two shape features of the post, that being the cross-sectional shape and the widening of the post near the fingertip, plus the width of the band itself, all work to keep the band from sliding toward the base of the post while the pick is being used. So the post plus the width of the band is slightly wider than the distance between the post inset walls near the fingertip region and more narrow near the base of the post.

Figure 81:
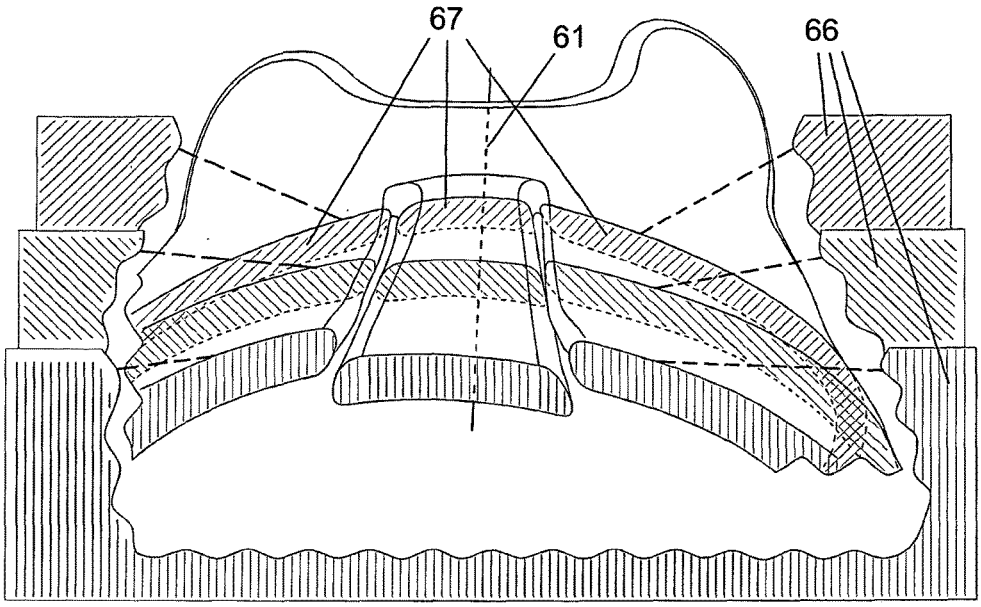

FIG. 81 shows that a number of cross-sectional slices of the post and post inset between the proximal and distal boundaries of the post can be examined to get a better understanding of the shape and why it works so well to hold the elastic band in place. The comparative dimensions of the post walls, inset walls, and band thickness that enable this feature to work well are shown best in FIG. 82 and can be described as follows:

There must exist on the longitudinal axis at least one cross-sectional slice made by a plane perpendicular to the longitudinal axis, the plane passing through both post inset longitudinal walls and through both post longitudinal walls such that the width of the post plus twice the thickness of the band is equal to or greater than the minimum distance between the post inset longitudinal walls. This basically means that at some point on the length of the post, the width of the post with the band in place threaded around the post will be great enough to keep the post from pulling up though the opening created by the post inset longitudinal walls.

The particular cross-sectional slice of the post shown in FIG. 76 and FIG. 78 is made by cutting the 3D CAD pick model with a plane that is perpendicular to the longitudinal axis. It's important to note that moving the plane to other points on the longitudinal axis would produce a cross-sectional slice that would show the width of the post to be greater than the width of the opening made by the opposing longitudinal walls of the post inset. This invention, however, requires that the post, band thickness, and post inset width described in the preceding paragraph and shown in FIG. 78 happen only at least one time along the length of the post.

Figure 77:
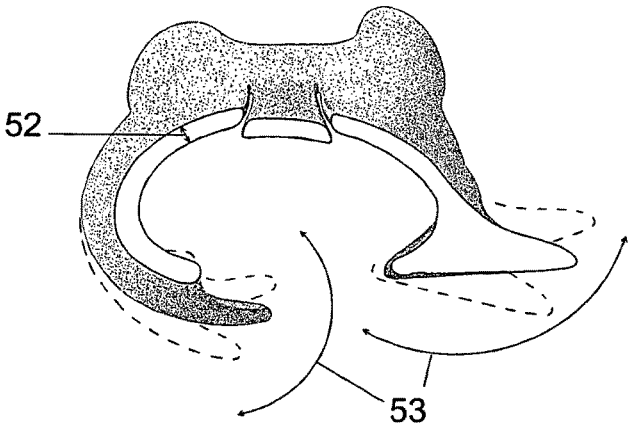

In the earlier description of this invention it was disclosed that the flexibility (53) of the pick can be controlled by adjustments of the wall thickness (52) of the saddle. A simple illustration is shown in FIG. 77 where it can be seen that the side walls of the pick can flex in or out depending on the finger size and shape. This is an important feature of this invention and adds to the comfort of wearing the device. Most thermoform plastics have some degree of flexibility. These are plastics that exist as solids at room temperature and become soft and formable at higher temperatures. Nylon, ABS, Ultem, acetal (Delrin) and acetal copolymers (Acetron) have all been used successfully in the manufacture of the pick saddle of this invention, and flexibility of the picks constructed of any of these materials can be controlled by varying the wall thickness. Variation of the wall thickness is accomplished during the 3D CAD design stage. Thinner walls make for more flexibility and for this invention, more is better. Increased flexibility not only adds to the comfort of the pick, but also allows a single pick size to fit a much larger range of finger sizes and shapes.

DESCRIPTION AND OPERATION—ALTERNATE EMBODIMENTS

As was disclosed earlier in the steps to construct the thumb pick, one embodiment of the thumb pick does not incorporate a pick element at all. A stringed instrument can be played with just the unmodified pick saddle and a means of securing the saddle to the thumb. The unmodified pick saddle is one which lacks the pick element and the securing post. An example can be seen in FIG. 37. Most players who use finger picking techniques do not use any aids at all and play with unaided fingers and thumbs. This particular embodiment complements this style and additionally allows the player to use very hard strokes without hurting his thumb.

A second embodiment which may not seem apparent at first is a pick which does not have a means of securing an elastic band to the pick saddle. It is quite possible to use the thumb pick without a post assembly or any other means to hold a band in place. Many rubber compositions, including latex and silicone, have naturally high friction against almost any clean surface. This is why many latex gloves are available pre-powdered. A clean latex or silicone band will cling quite adequately to a clean pick saddle surface of this invention without any other securing means to hold it in place.

Figure 89:
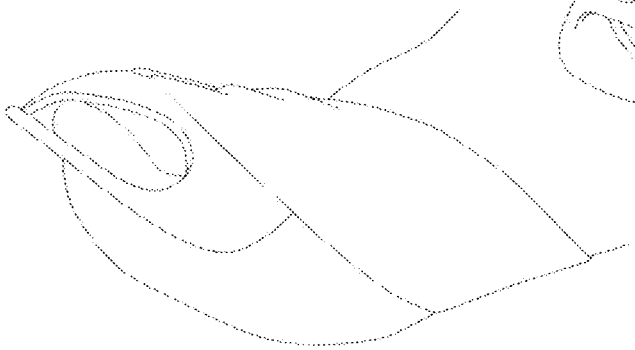
Figure 90:
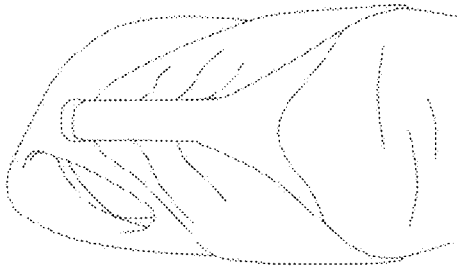

One alternate embodiment concerns the pick element of the thumb pick. Most of the upper surface of the saddle adjacent to the pick element is removed as shown in FIGS. 89 and 90, revealing the left upper tip of the thumb for a right handed thumb pick. This elimination of the upper surface of the pick element leaves only the lower striking surface which is very similar to that of a flat pick. This allows the pick element to flex as it contacts a string and causes this plectrum shaped surface to perform even more like a finger held flat pick because it very closely duplicates the dynamics of these plectrums as it is played. It does this because the lower striking surface is not directly connected to the saddle as it was before when the upper striking surface was holding it in place. This open cavity in the upper surface of the saddle allows the thumb to slide forward so that the pick is positioned even more snugly upon the thumb.

The advantages of this invention especially for plectrum users is threefold. First, one problem with plectrums is that they are occasionally dropped. This invention eliminates that problem entirely. Second, this invention eliminates the fatigue incurred by players who use plectrums by constantly keeping their thumbs and index fingers pressed together. And the third advantage is that since the index finger is no longer needed to keep a tight grip on a plectrum, it can be freed up to possibly do other things—like eventually trying a fingerpick of this invention for the freed up index finger and experimenting with new sounds, rhythms, and playing ability.

Figure 91:
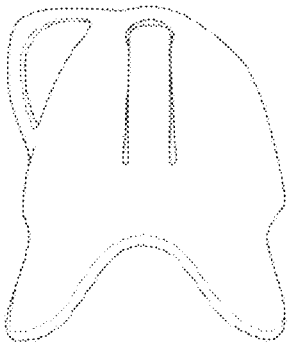

Another embodiment of the thumb pick is another modification of the pick element. In FIG. 91 it can be seen that the solid surface of the pick element has been replaced with a shape similar to a ring. This goes even further than the previous embodiment in producing a flexible pick element. Since there is less surface to bend the ring shape bends much more readily. And if still more flexibility is needed the ring shape can be flattened into a narrow strip. A high degree of flexibility allows the pick element to have the flexibility of the thinnest of flat picks.

Figure 92:
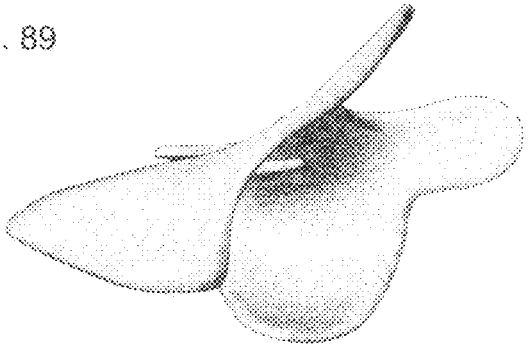
Figure 93:
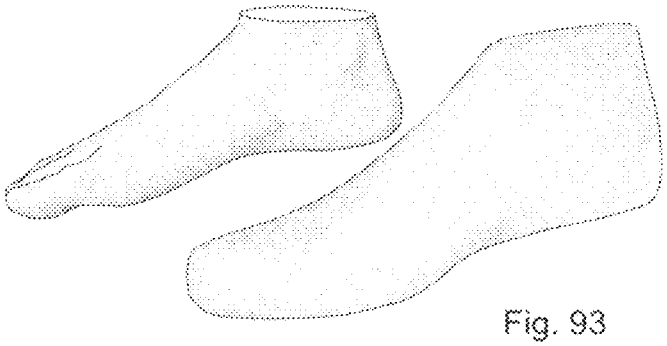
Figure 94:
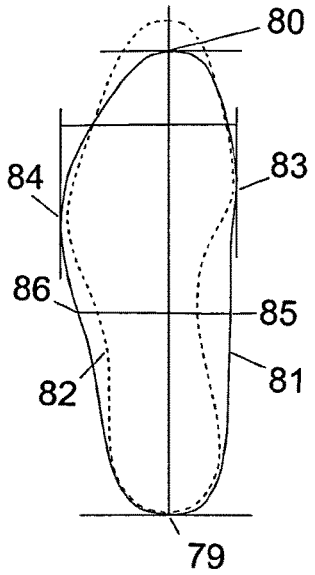
Figure 95:
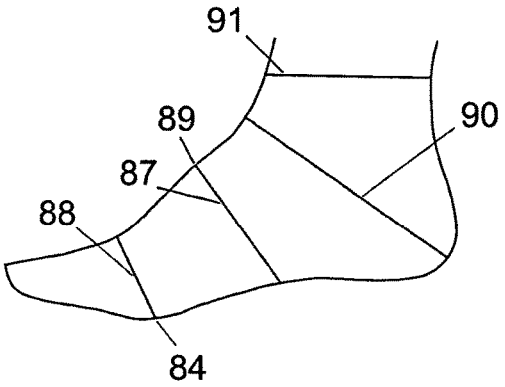
Figure 96:
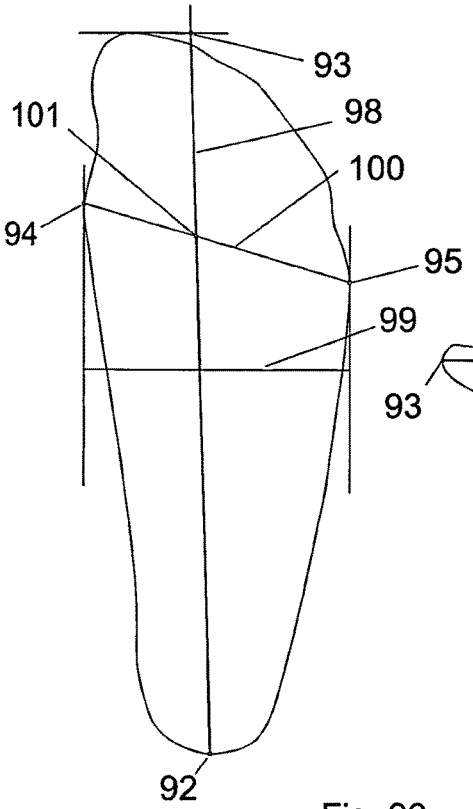
Figure 97:
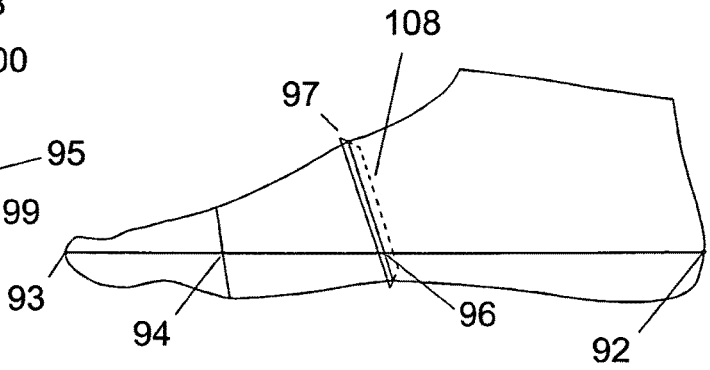
Figure 98:
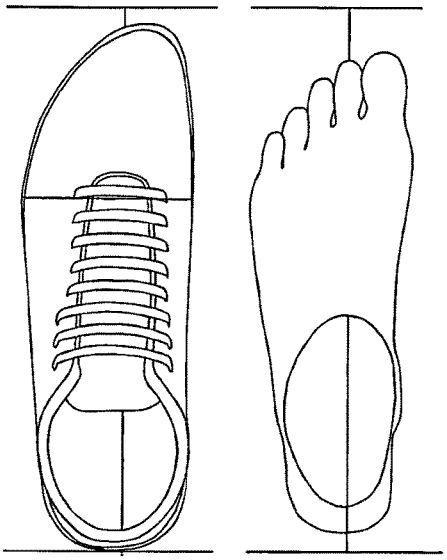
Figure 99:
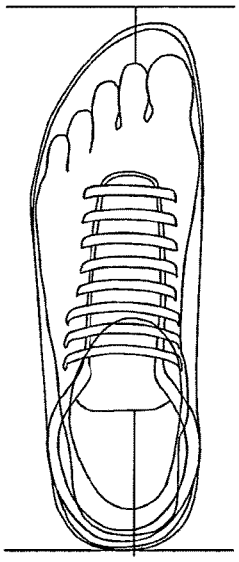
Figure 100:
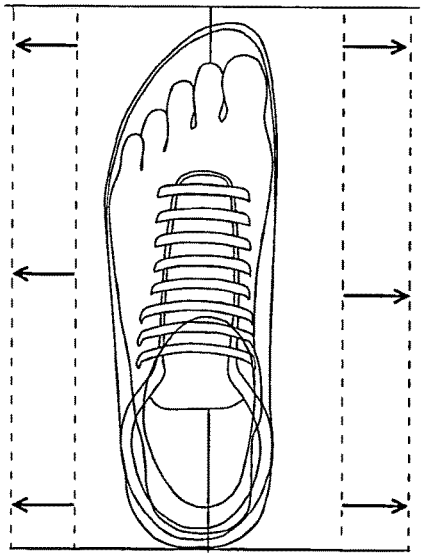
Figure 101:
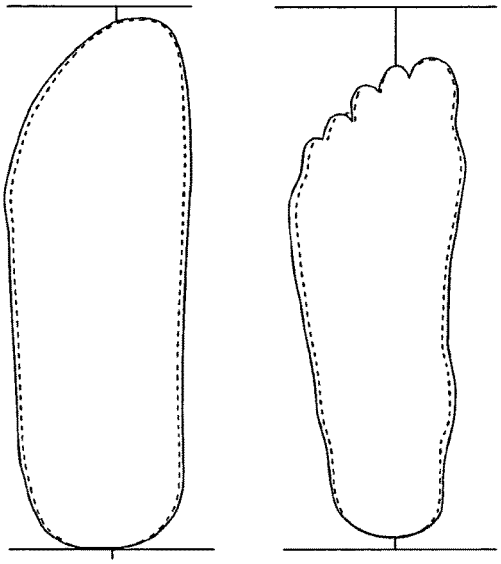
Figure 102:
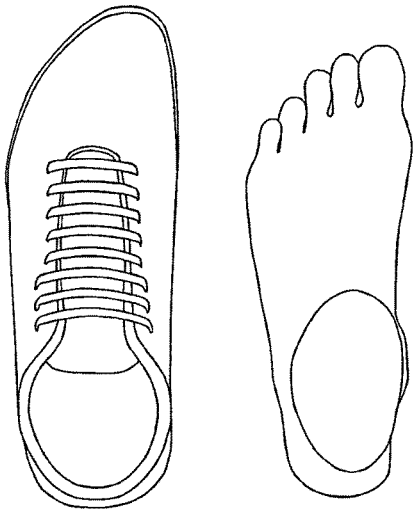
Figure 103:
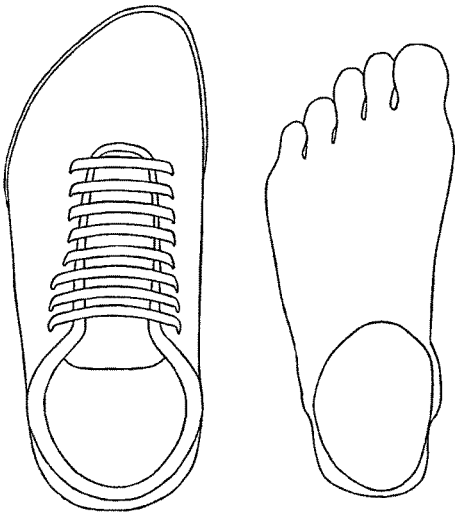
Figure 104:
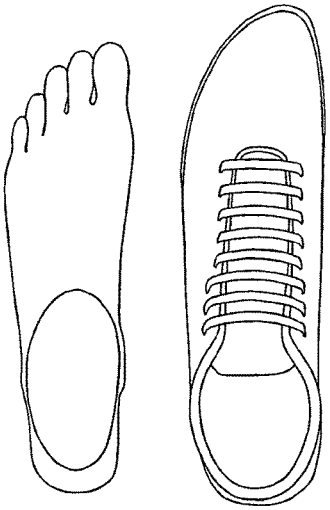
Figure 105:
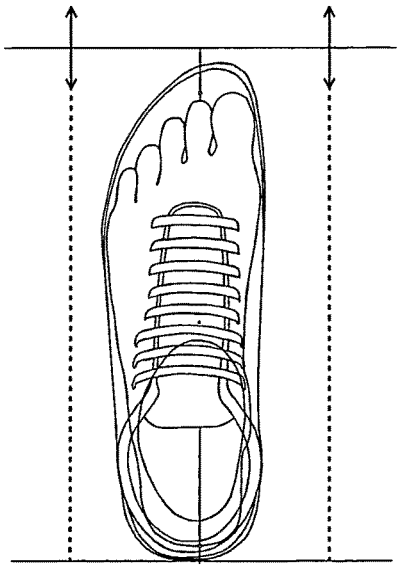
Figure 106:
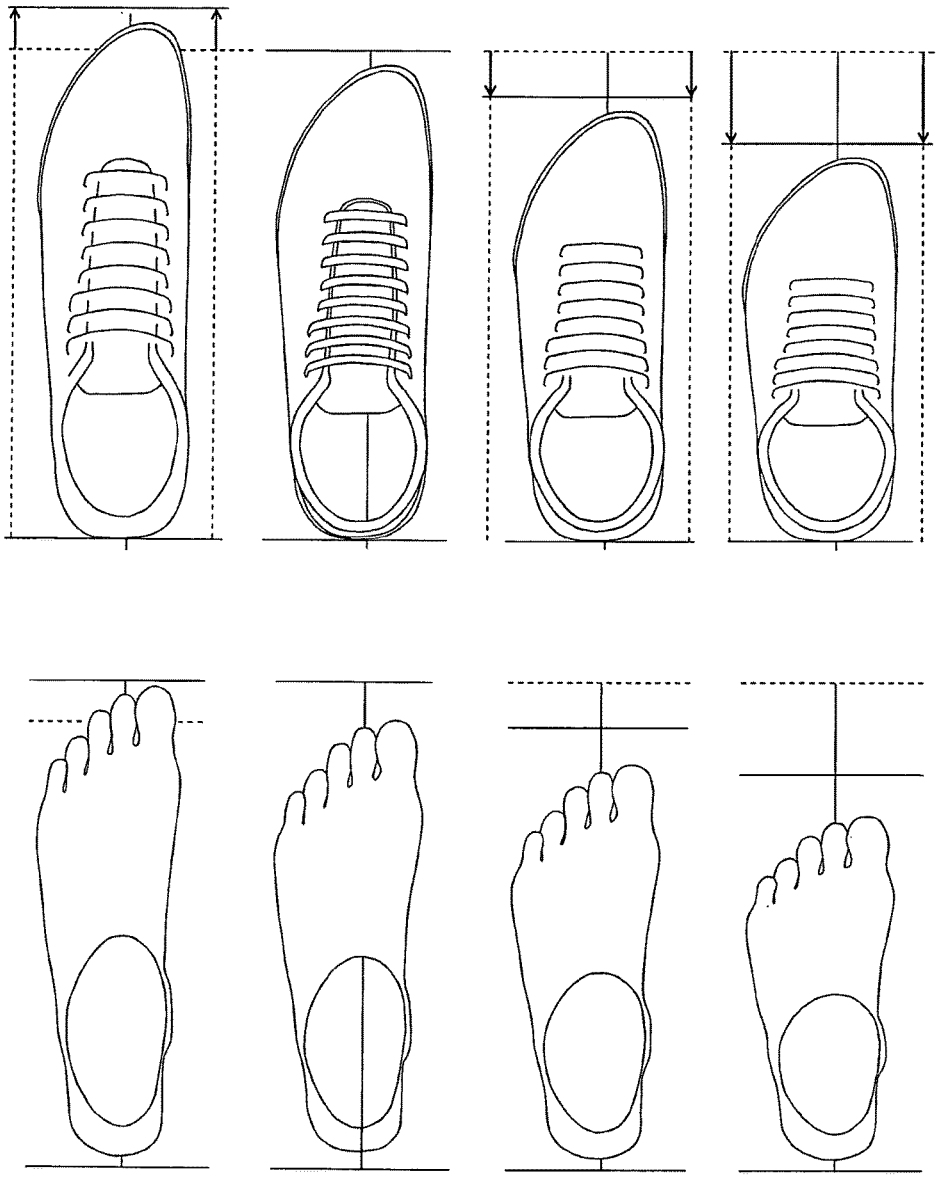
Figure 107:
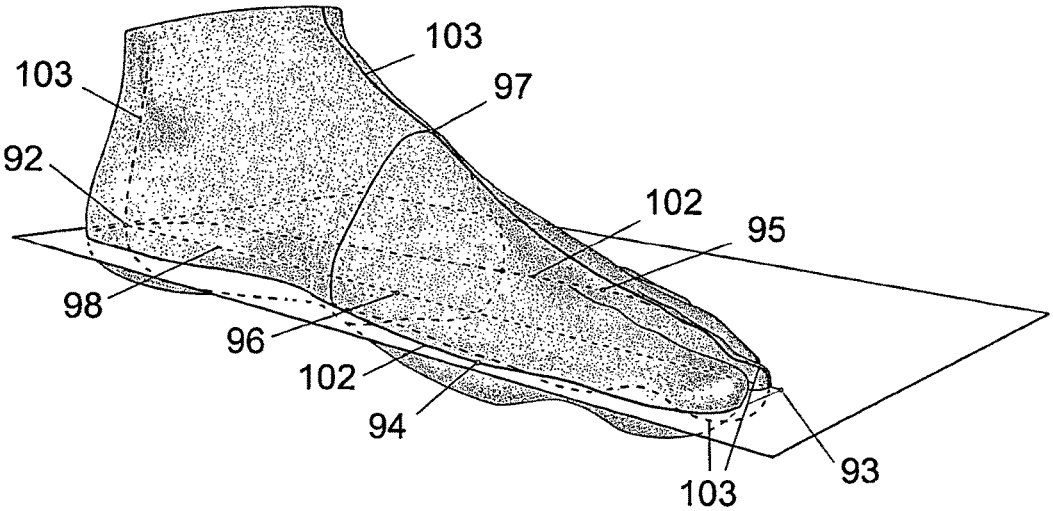
Figure 108:
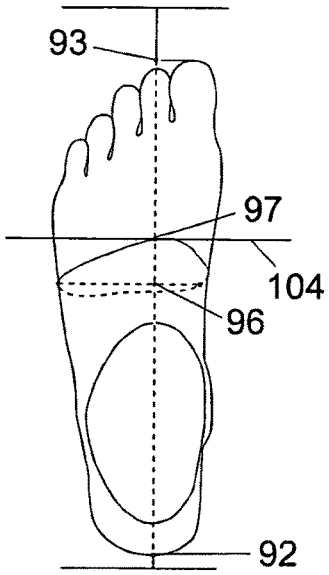
Figure 109:
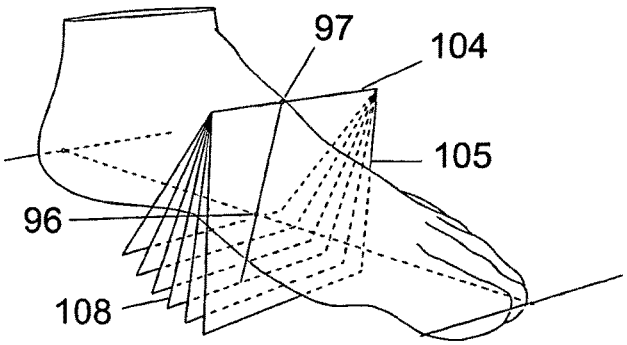
Figure 110:
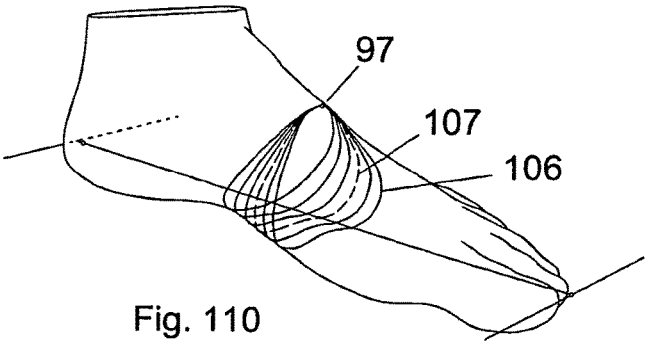
Figure 111:
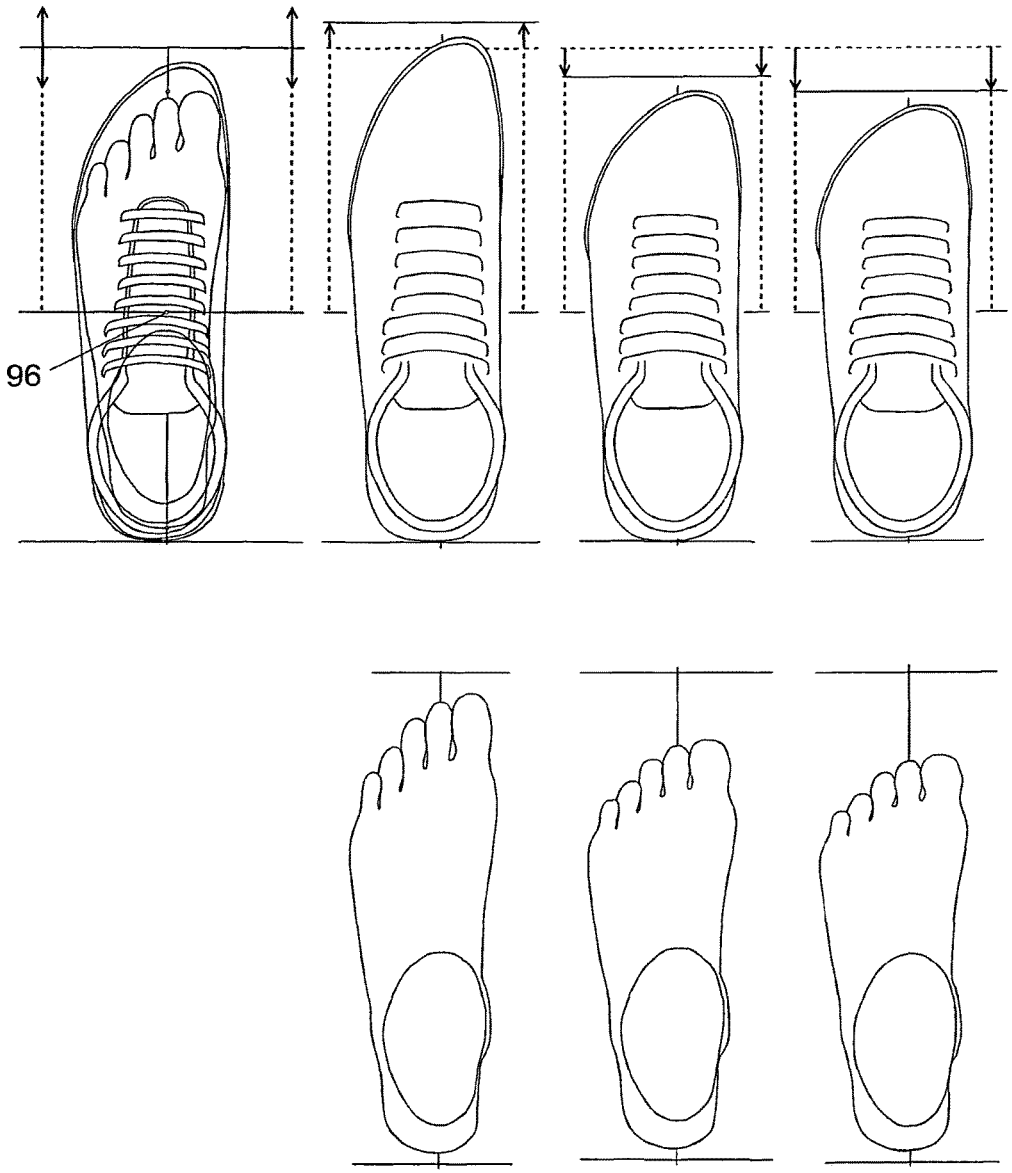
Figure 112:
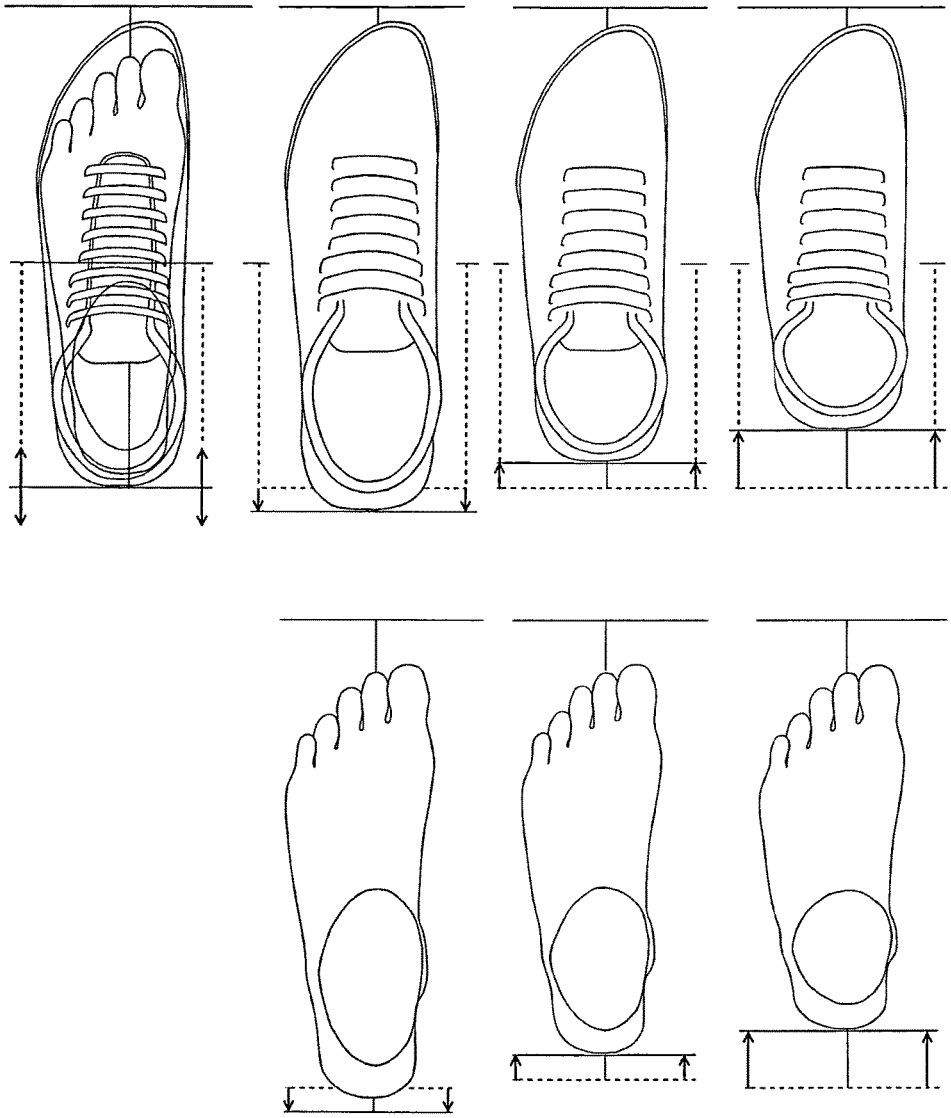
Figure 113:
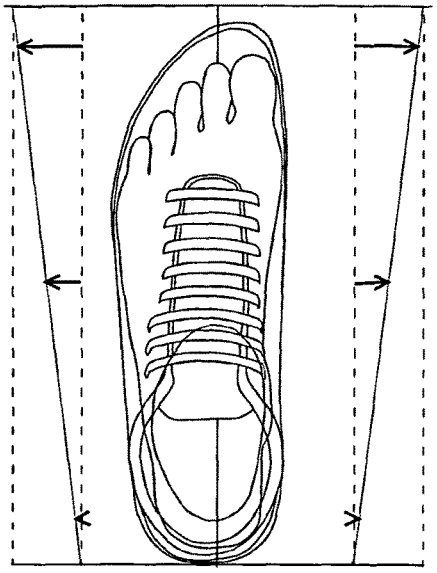
Figure 114:
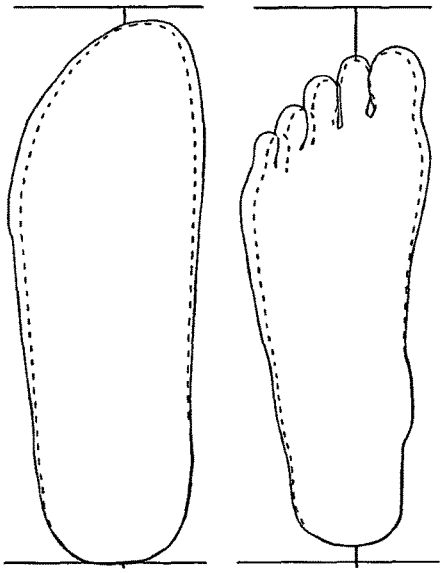
Figure 115:
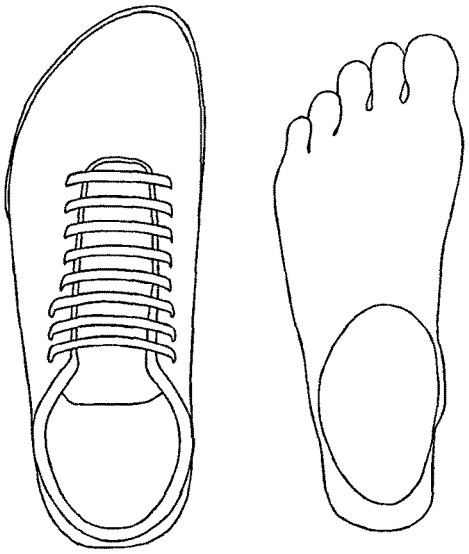
Figure 116:
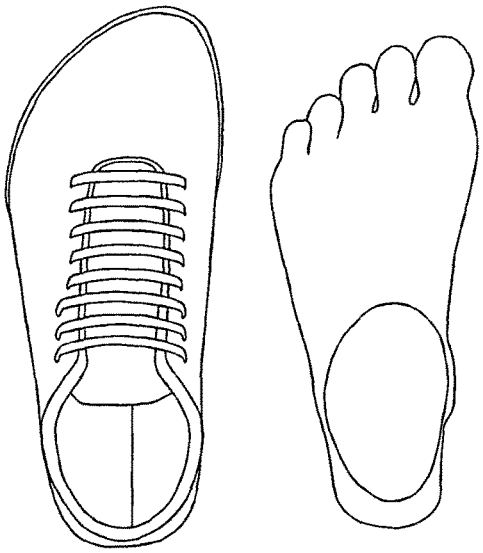
Figure 117:
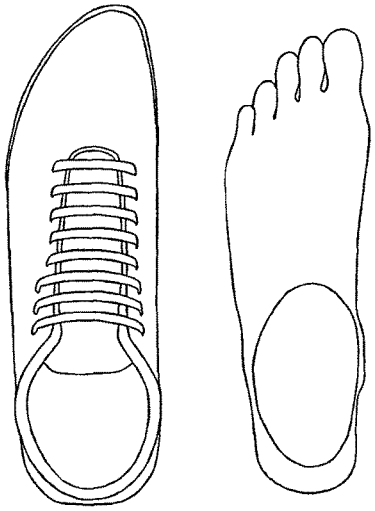
Figure 118:
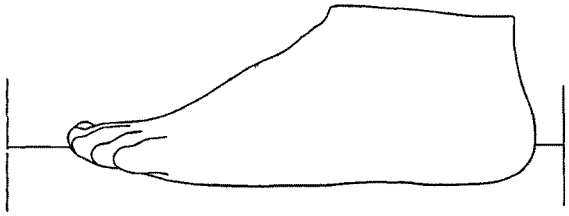
Figure 119:
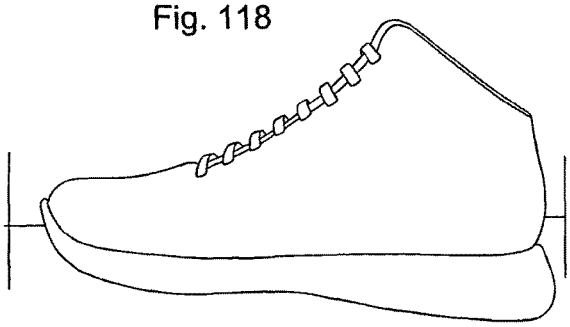
Figure 120:
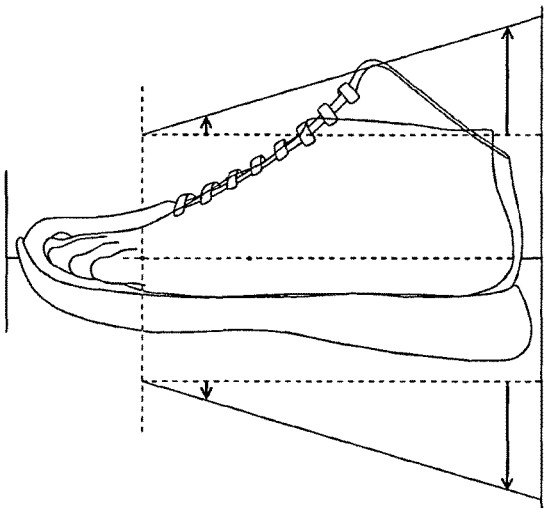
Figure 121:
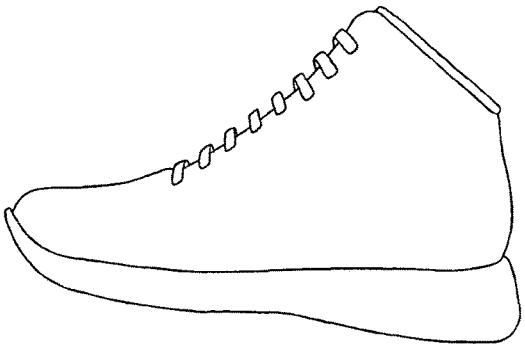
Figure 122:
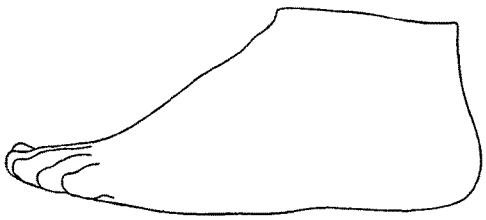
Figure 123:
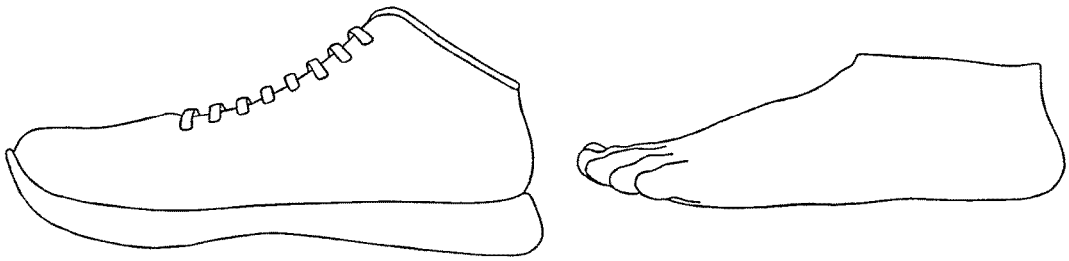
Figure 124:
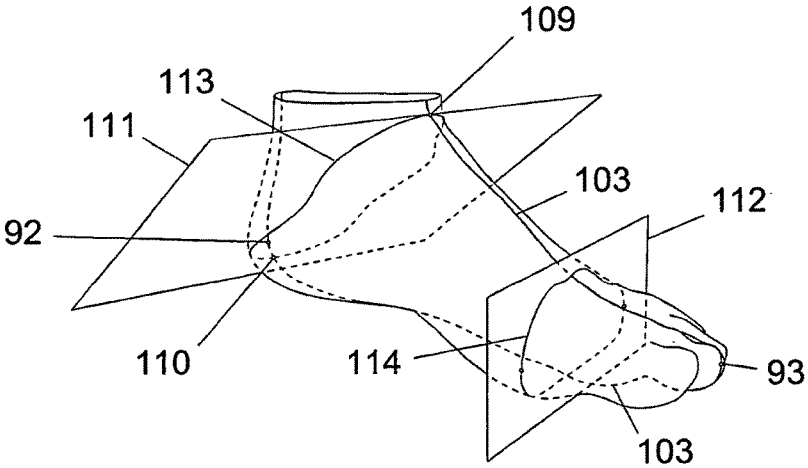

A third embodiment of a thumb pick of this invention is another shape of the pick element. FIG. 92 shows a pick element which departs from the strategy of producing a striking surface which is a thin sheet of material and instead is a wedge shape.

CONCLUSION

The prior art contoured pick was created originally to solve age old problems with traditional plucking/strumming aids that are worn upon the finger or thumb. The main problems for many years had been discomfort, clumsy, noisy, and unnatural feeling of all existing products. The prior art contoured pick, with a novel design that capitalized on the natural shape and strategic placement of the striking edge, or pick flange, changed the paradigm for such strumming aids. This invention supersedes the functionality of the prior art contoured pick and transforms the shape and performance into something the author calls a "bionic" device because of the way this invention feels and performs, as it feels like a natural extension of a finger or thumb.

DRAWING FIGURES

FIG. 1 Top view of prior art "contoured pick" thumb pick with band.

FIG. 2 Top view of thumb pick of this invention with band.

FIG. 3 Same as FIG. 1 except the band has been omitted for clarity.

FIG. 4 Top view of thumb pick of this invention shown without band.

FIG. 5 Side view of thumb pick of prior art contoured pick with band.

FIG. 6 Side view of a thumb pick of this invention shown with band.

Figure 7:
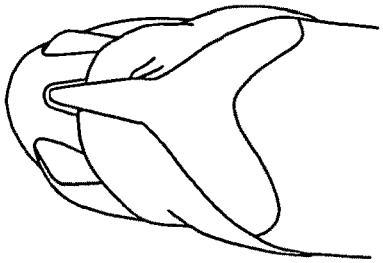

FIG. 7 Top view of an alternate embodiment of a finger pick of this invention.

Figure 8:
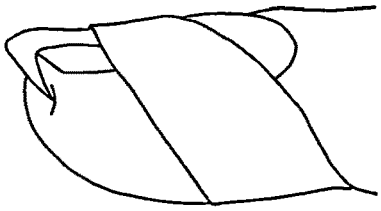

FIG. 8 Same as FIG. 7 but shown as a side view.

Figure 9:
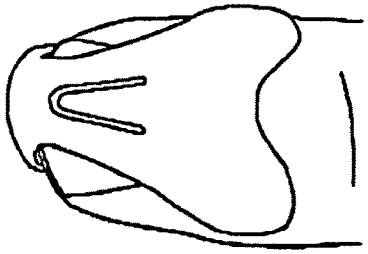

FIG. 9 Top view of an alternate embodiment of a finger pick of this invention, shown without a band.

Figure 10:
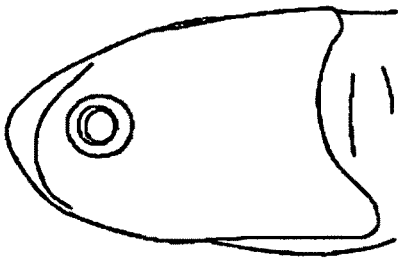

FIG. 10 Top view of a finger pick of the prior art contoured pick, shown without a band.

Figure 11:
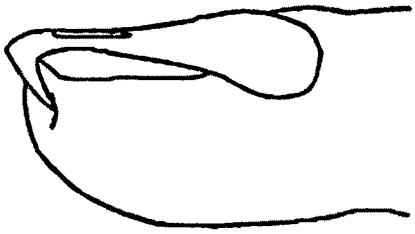

FIG. 11 Same as FIG. 9 but showing a side view.

Figure 12:
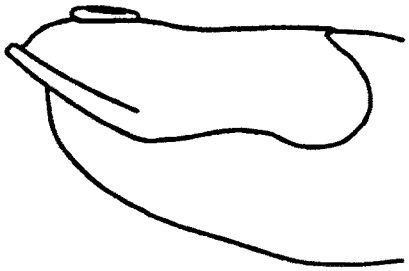

FIG. 12 Same as FIG. 10 but showing a side view.

Figure 13:
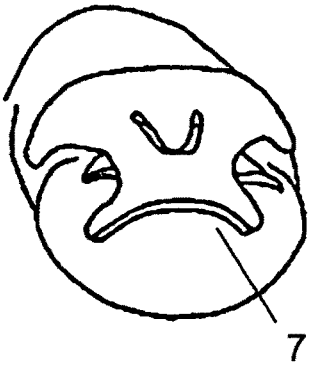

FIG. 13 Same as FIG. 11 and FIG. 9 but showing a front view.

Figure 14:
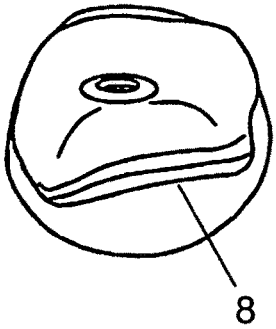

FIG. 14 Same as FIG. 12 and FIG. 10 but showing a front view.

Figure 15:
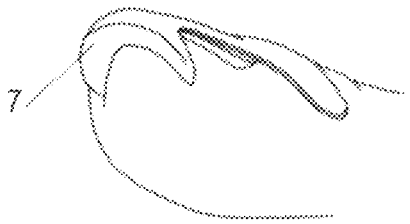

FIG. 15 Same as FIG. 13 but showing a partial underside view.

Figure 16:
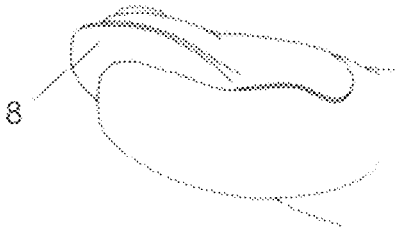

FIG. 16 Same as FIG. 14 but showing a partial underside view.

FIG. 17 Thumb pick of this invention for a right hand thumb, shown without a band.

FIG. 18 Thumb pick of prior art contoured pick shown without a band.

FIG. 19 Point cloud of a 3d scanned model of a right hand thumb, points displayed using 3D CAD software.

FIG. 20 Thumb surface created from the point cloud of FIG. 19 comprising a network of intersecting mathematical curves.

FIG. 21 Thumb surface created from the point cloud of FIG. 19 comprising a network of linked polygons.

Figure 22:
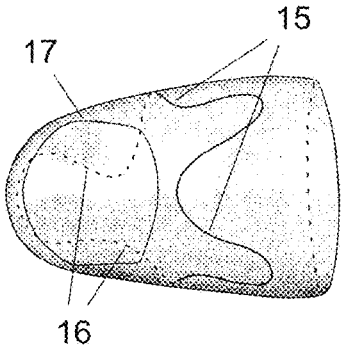

FIG. 22 Thumb surface of FIG. 20 upon which a contour surface has been drawn and through which an encroachment curve has been constructed.

Figure 23:
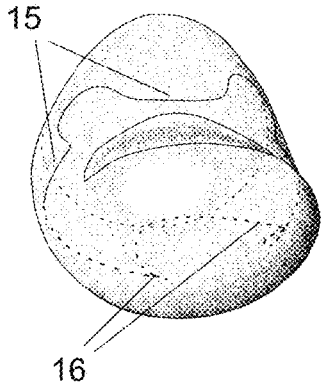

FIG. 23 Same as FIG. 22 but showing a front view.

Figure 24:
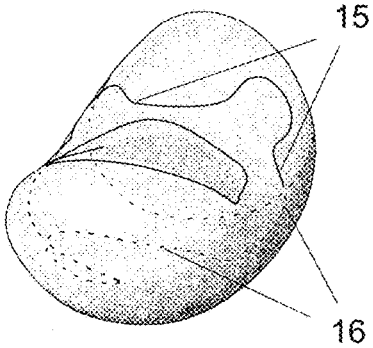

FIG. 24 Same as FIG. 23 but showing the front view from a slightly different perspective.

Figure 25:
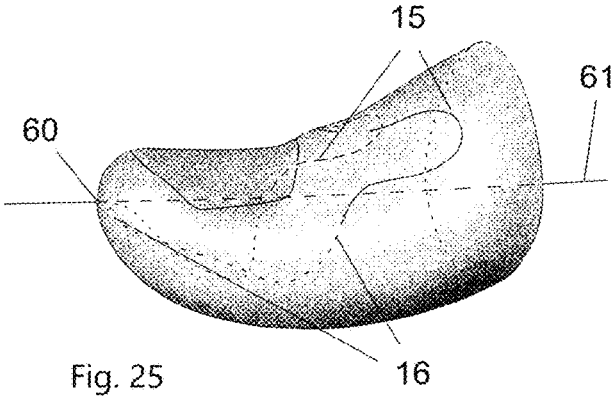

FIG. 25 Same as FIG. 22 but showing a side view.

FIG. 26 Transparent top view of the thumb surface of FIG. 22 shown with the longitudinal line of symmetry and the origin.

FIG. 27 Inner perimeter curve shown at a side view, also shown with curve of thumb nail for perspective.

FIG. 28 Inner perimeter curve and thumb nail curve shown at a front view.

FIG. 29 Modified longitudinal curves and modified lateral curves which will form the network of curves that define the shape of the modified thumb surface.

FIG. 30 Modified thumb surface showing the inner perimeter curve and the upper encroachment boundary, with the original lower longitudinal curve and several of the original lateral curves shown for comparison.

FIG. 31 The inner saddle surface formed by cutting the modified thumb surface with the inner perimeter curve. Also shown is the upper encroachment boundary with the original lower longitudinal curve and several of the original lateral curves shown for comparison.

FIG. 32 Front view of the inner saddle surface with the original lower longitudinal curve and several of the original lateral curves shown for comparison.

FIG. 33 A top and rearward view of the inner saddle surface, also shown with the original lower longitudinal curve and several of the original lateral curves shown for comparison.

FIG. 34 A rearward view of both the inner and outer saddle surfaces and the offset distance between the two surfaces.

FIG. 35 Inner and outer perimeter curves are shown connected with perimeter connecting strip lateral curves to define the shape of the perimeter connecting strip (not shown).

FIG. 36 The perimeter connecting strip formed from the network of curves of FIG. 35.

FIG. 37 A fully enclosed pick saddle for a thumb pick of this invention.

FIG. 38 A top view of the pick saddle of FIG. 37 shown with a circular area that will be enlarged for FIG. 39.

FIG. 39 An enlarged view of a portion of FIG. 38 showing the inner and outer post inset curves.

FIG. 40 An enlarged view of a portion of FIG. 38 showing the area of the pick saddle that has been cutout with the inner and outer post inset curves.

FIG. 41 The post upper and post lower cutouts formed from cutting the inner and outer surfaces with the inner and outer post inset curves.

FIG. 42 Upper and lower post perimeter curves shown with the inner and outer post inset curves but shown without the cutout surfaces for clarity.

FIG. 43 Post upper and post lower formed by cutting the upper and lower post cutouts with the upper and lower post perimeter curves.

FIG. 44 Rearward view of the post upper and post lower shown with the inner and outer post inset curves.

FIG. 45 Post connecting strip shown with the post upper and post lower.

FIG. 46 Rearward view of the inner and outer post inset curves.

FIG. 47 Post connecting strip.

FIG. 48 The post assembly formed by joining the post inset connecting strip, the post connecting strip, and the post upper and post.

FIG. 49 Side view of the post assembly also showing an area where the post connecting strip overlaps with the post inset connecting strip.

FIG. 50 Side view of the post assembly after the post has been rotated upward to avoid the overlap of FIG. 49 and to allow easy attachment of the band.

FIG. 51 Rearward view of a portion of the pick saddle and the post assembly showing how the post assembly fits into the pick saddle.

FIG. 52 Same view as FIG. 51 but with the post assembly in place on the pick saddle.

FIG. 53 Rearward view of the modified pick saddle.

FIG. 54 Lower rear view of modified pick saddle with pick element inset curve drawn on the surface.

FIG. 55 Same view as FIG. 54 of modified pick saddle with the outer surface cut away by the pick element inset curve.

FIG. 56 First embodiment of the pick element for a right hand thumb pick, shown at a view corresponding to the view of FIG. 54.

FIG. 57 Pick element shown with view corresponding to view of FIG. 55.

FIG. 58 $2^{nd}$ embodiment of modified pick saddle formed by combining modified pick saddle of FIG. 55 with pick element of FIG. 56.

FIG. 59 Same $2^{nd}$ embodiment of modified pick saddle of FIG. 58 shown in the same view as FIGS. 55 and 57.

FIG. 60 Same modified pick saddle as FIG. 58 but shown as an underside view.

Figure 61:
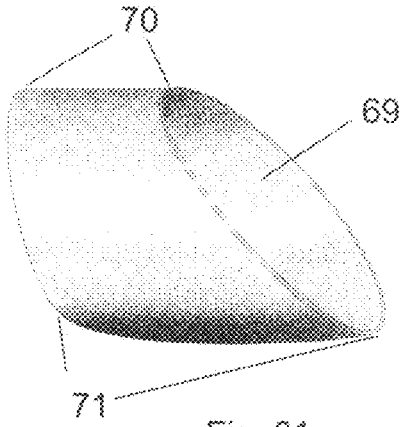

FIG. 61 Side view of an elastic band of this invention.

Figure 62:
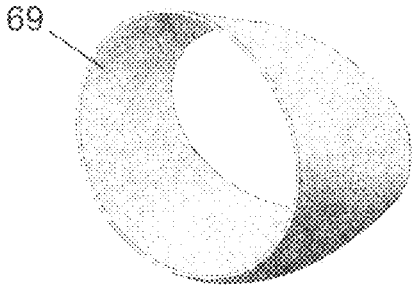

FIG. 62 Front view of an elastic band of this invention.

FIG. 63 $1^{st}$ step in the installation of the elastic band onto the pick saddle—band is threaded under the post.

FIG. 64 $2^{nd}$ step in the installation of the elastic band—post is twisted as shown in the drawing.

FIG. 65 $3^{rd}$ step in the installation of the elastic band—post is pushed below the surface of the pick saddle.

Figure 66:
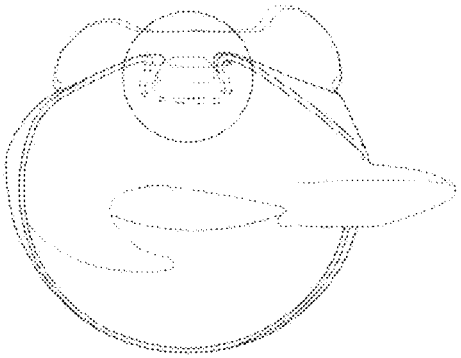
Figure 67:
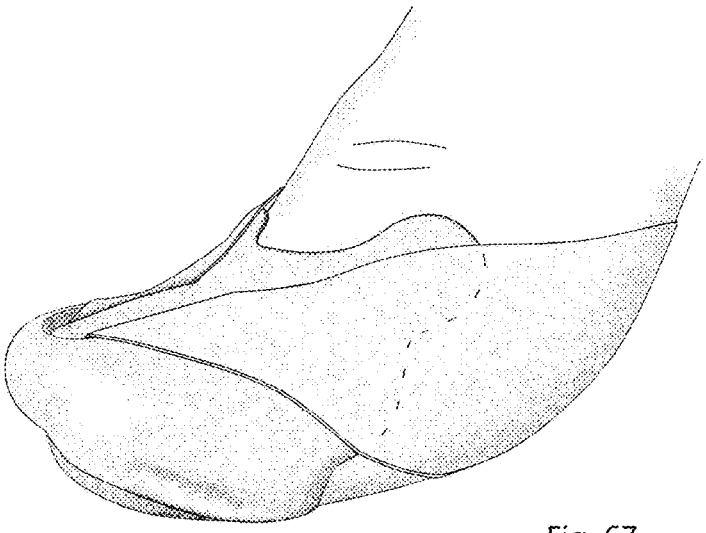
Figure 68:
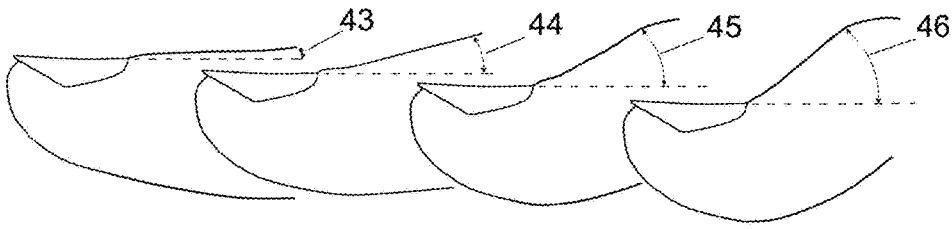
Figure 69:
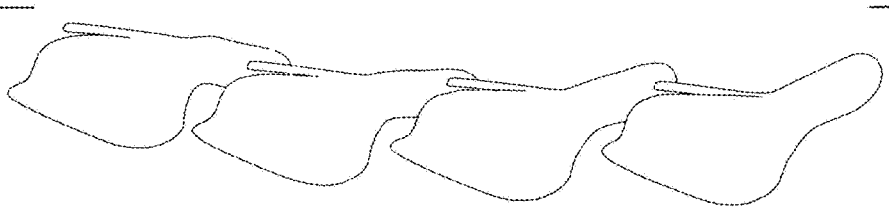
Figure 70:
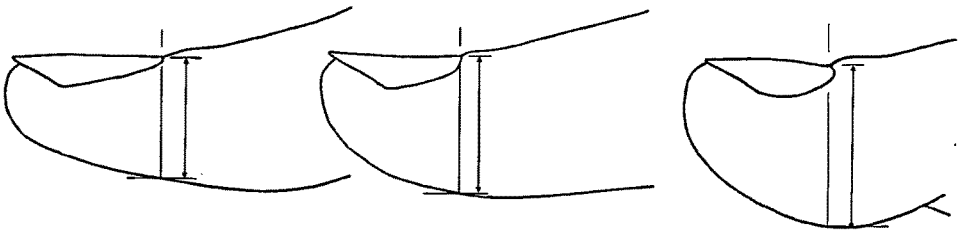
Figure 71:
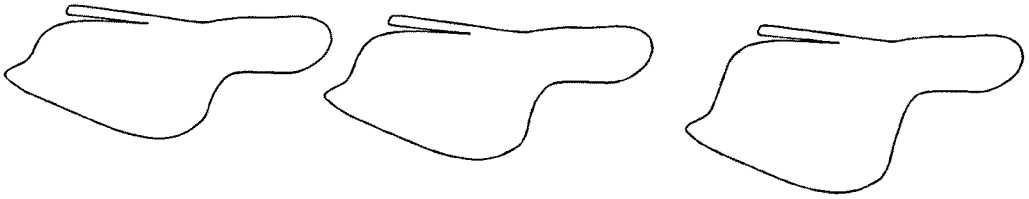
Figure 72:
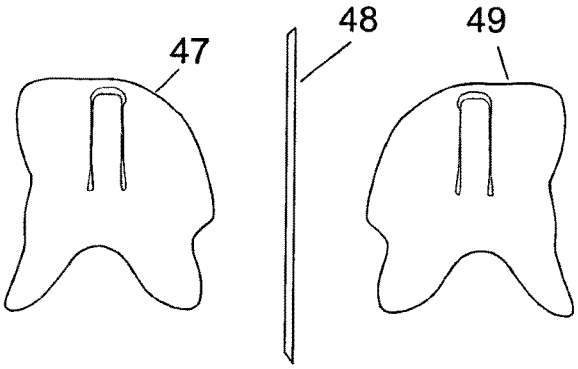
Figure 73:
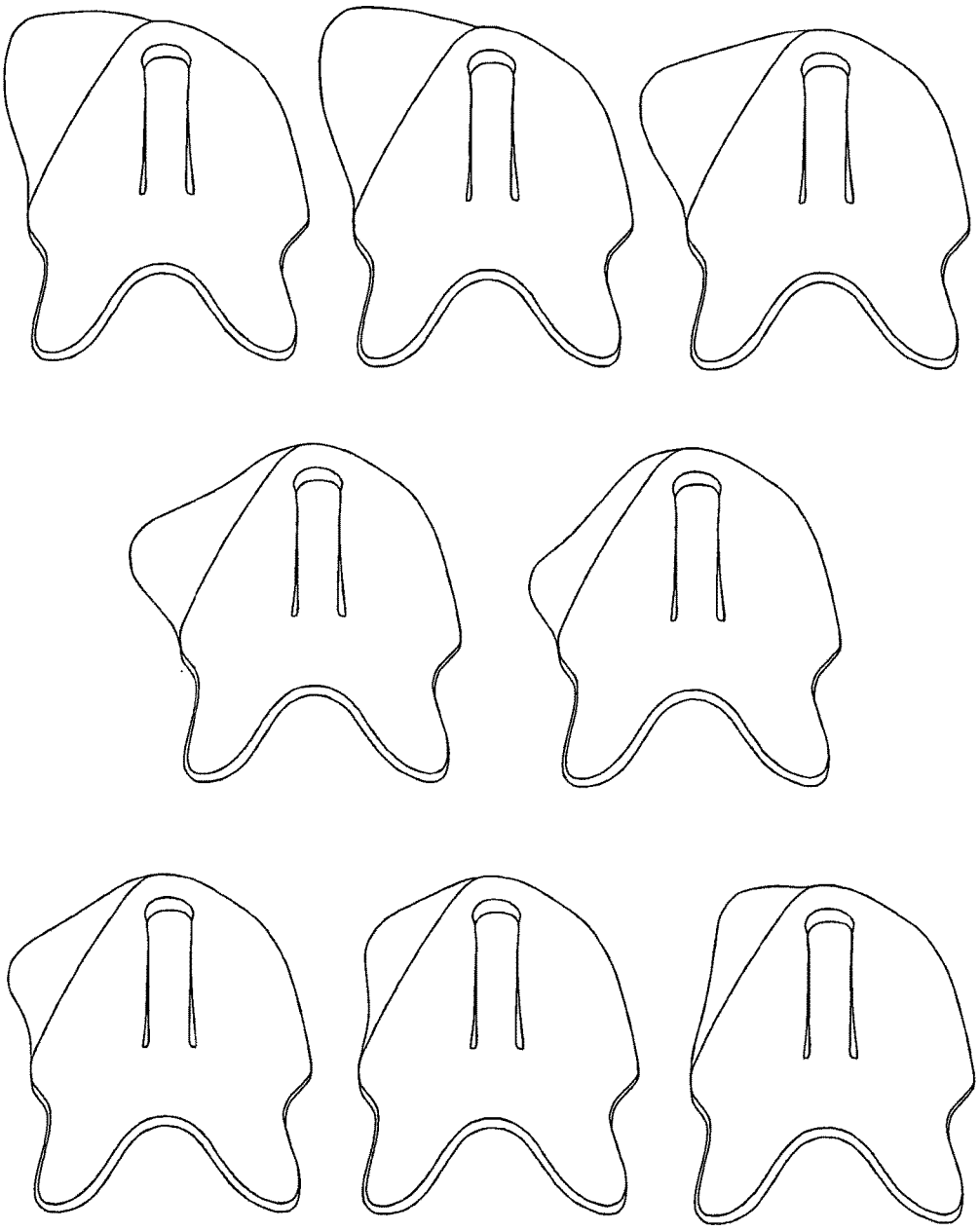
Figure 74:
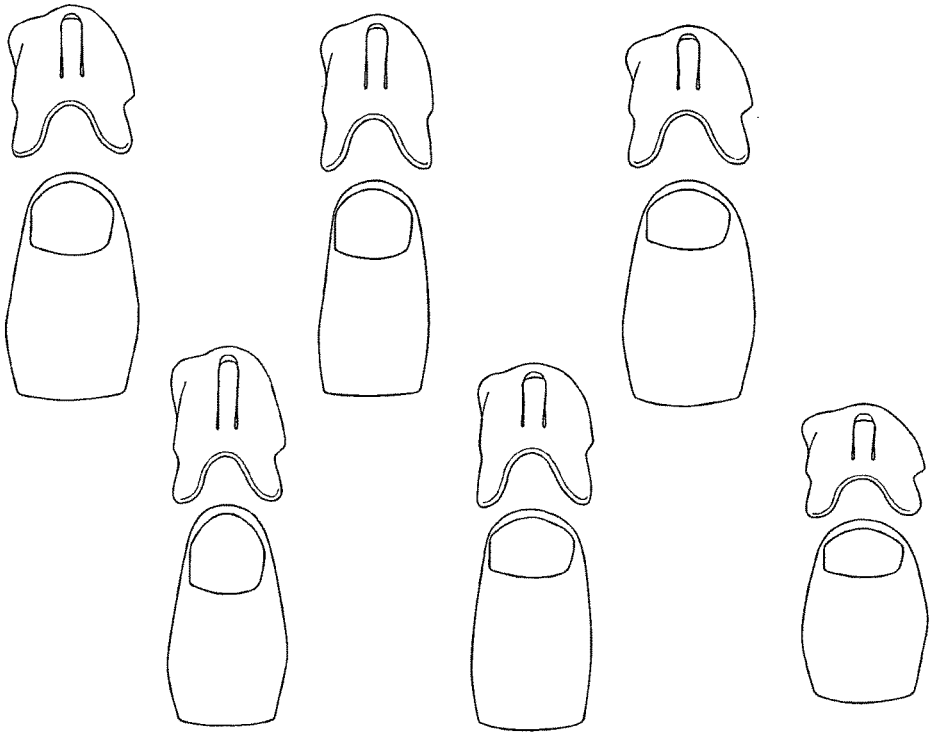
Figure 75:
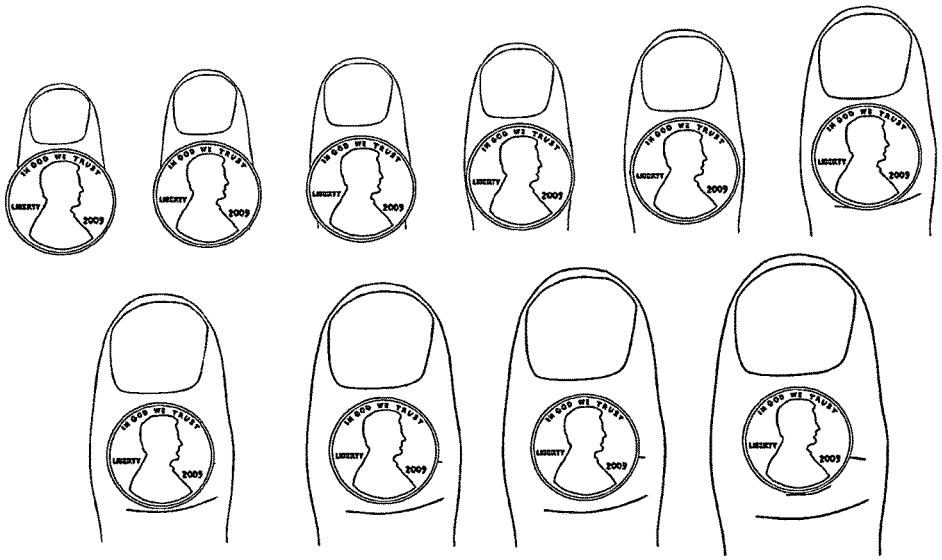

FIG. 66 $4^{th}$ step in the installation of the elastic band—post is rotated back from its twisted position and rests with the band beneath the surface of the saddle.

FIG. 67 $2^{nd}$ embodiment of a thumb pick of this invention as it would be worn on a thumb.

FIG. 76 Cross-sectional front view of a right hand thumb pick at the point on the longitudinal axis of the maximum width of the post, showing the unique shape of the post and post inset.

FIG. 77 Same view as FIG. 76 showing how the wall thickness of a pick of this invention can be varied to enhance or reduce flexibility of the pick.

FIG. 78 Enlargement of the circular area of FIG. 76 showing the unique design of the post longitudinal walls and the post inset longitudinal walls.

Figure 79:
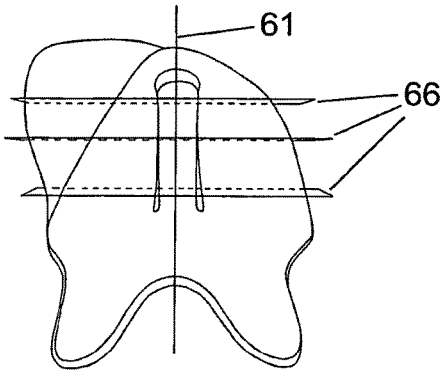

FIG. 79 Top view of a thumb pick showing the longitudinal axis and three of any number of cross-sectional planes which can exist along the longitudinal axis that would also intersect the longitudinal walls of the post.

Figure 80:
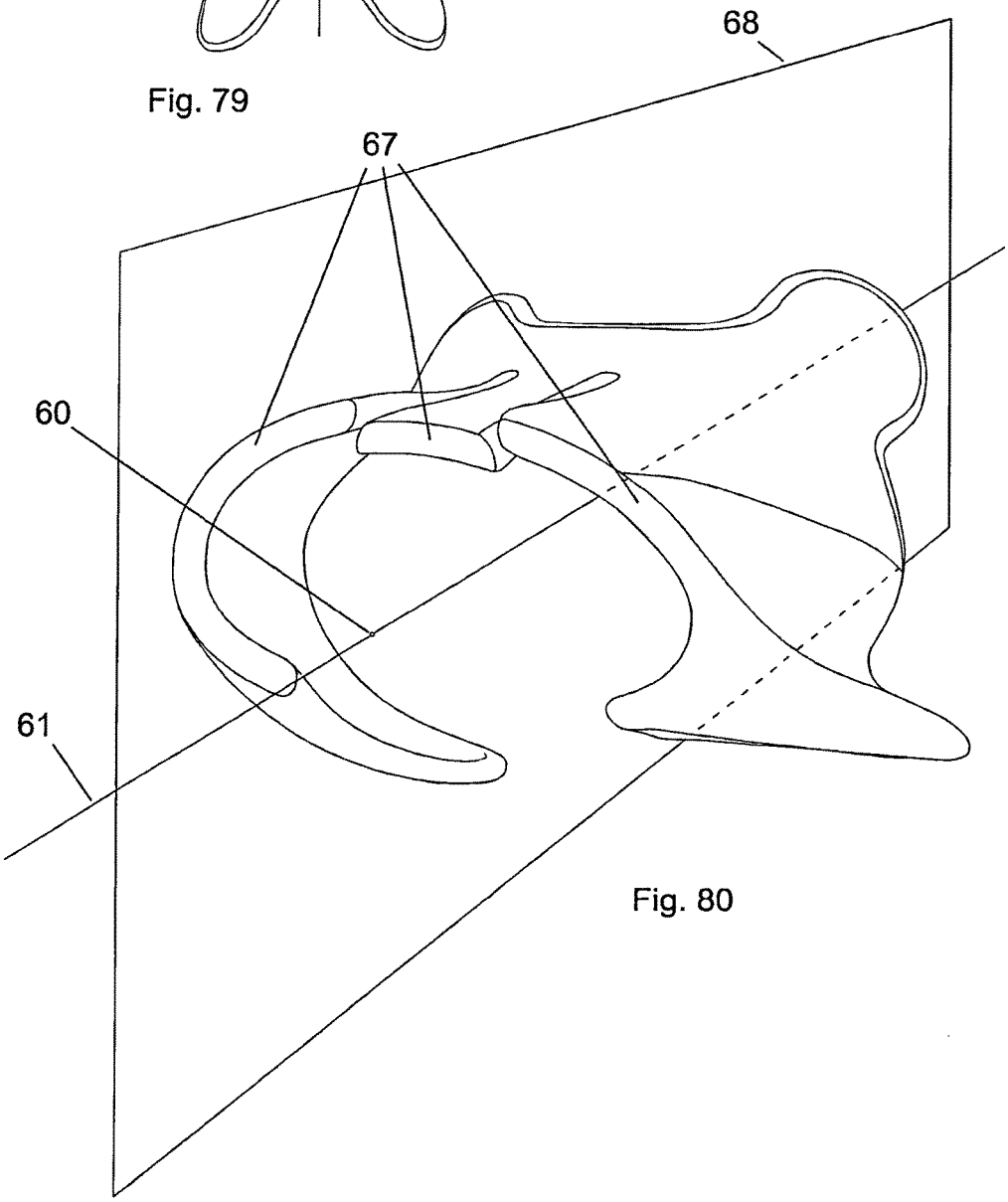

FIG. 80 Front view of a cross-sectional slice of a right hand thumb pick, also showing the longitudinal axis and the longitudinal plane of symmetry.

FIG. 81 Front view of right hand thumb pick showing three cross-sectional slices that intersect the longitudinal walls of the post.

Figure 82:
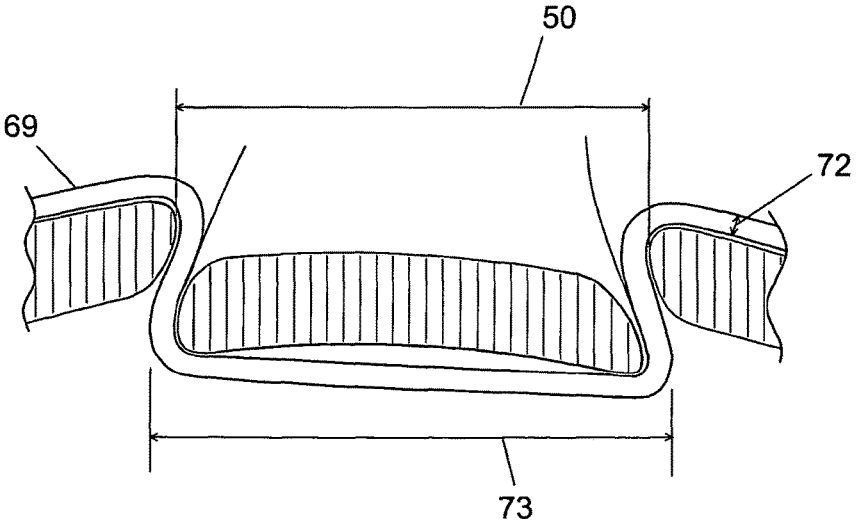

FIG. 82 Enlarged view of FIG. 81 showing the most distal of the three cross sections of FIG. 81, also showing the contribution of the thickness of the elastic band in preventing the band from pulling the post upward during use.

FIG. 83 Side view of the preferred embodiment of a finger pick of this invention, showing the open area of the saddle near the fingertip, the lower extent of the encroachment surface, and the semi-oval ring shape of the pick element.

FIG. 84 Side view of prior art contoured finger pick as a comparison to FIG. 83.

FIG. 85 Lower and somewhat front view of the finger pick of FIG. 83.

FIG. 86 Lower and frontal view of prior art contoured pick as a comparison to FIG. 85.

FIG. 87 Underside view of the finger pick of FIG. 83 showing the asymmetry of the shape of the ring of the pick element from one side of the longitudinal axis to the other.

FIG. 88 Front and lower view of the finger pick of FIG. 83 showing that the asymmetrical design of the ring shape is due to the direction of travel of the string as it is being plucked.

FIG. 89 Side view of $2^{nd}$ alternate embodiment of a thumb pick of this invention, showing a pick element where a substantial portion of the upper surface has been removed to reveal the thumb.

FIG. 90 Top view of FIG. 89.

FIG. 91 $3^{rd}$ alternate embodiment of a thumb pick of this invention, showing that a substantial portion of the striking surface of the pick element has been removed, leaving a perimeter of material in a somewhat ring-like shape.

FIG. 92 $4^{th}$ alternate embodiment of a thumb pick of this invention, showing that the thickness of the striking portion of the pick element has been increased and formed into a wedge shape.

LIST OF REFERENCE NUMERALS

1. Preferred securing means of the elastic band to the pick saddle of prior art "contoured pick". An eyelet is used to secure the band to the saddle.

2. Securing means of this invention of the elastic band to the pick saddle. This "U" shaped cavity in the surface of the saddle creates the securing post.

3. The pick flange for a thumb pick of prior art "contoured pick". It is the part which strikes the string of the stringed musical instrument.

4. The pick element of a thumb pick of this invention. It has a lower surface for downstrokes, and a smooth upper surface for backstrokes.

5. The elastic band of prior art contoured pick.

6. The elastic band of the improvement.

7. Alternate embodiment of a pick element of this invention for a finger pick, showing curvature in the lateral direction.

8. The pick flange for a finger pick of prior art contoured pick.

9. (Intentionally omitted)

10. Encroachment surface

11. (Intentionally omitted)

12. A virtual 3D surface of a thumb constructed of a network of intersecting longitudinal and lateral curves which define the surface of the thumb.

13. Longitudinal curves of a 3D CAD model constructed of a network of curves.

14. Lateral curves of a 3D CAD model constructed of a network of curves.

15. The contour curve which defines the shape and perimeter of the pick saddle on the upper (upper) side of the thumb.

16. The lower encroachment curve which defines the perimeter of the pick saddle on the lower side of the thumb. It is named such because it encroaches past the surface of the thumb.

17. The outline of the thumb nail is only for clarity of the drawing.

18. The inner perimeter curve formed by joining the contour curve with the lower encroachment curve.

19. Modified longitudinal curve defining the modified thumb surface in the longitudinal direction.

20. Modified lateral curve defining the modified thumb surface in the lateral direction.

21. Modified thumb surface which will define the inner surface of the pick saddle.

22. The inner saddle surface formed by trimming the modified thumb surface with the inner perimeter curve.

23. Outer saddle surface formed by offsetting the inner saddle surface in an outward direction at an offset distance which determines the wall thickness of the pick saddle.

24. Offset distance is the distance at which the outer saddle surface is separated from the inner saddle surface.

25. Outer perimeter curve is the perimeter of the saddle outer surface.

26. Lateral curves of the perimeter connecting strip.

27. Perimeter connecting strip joining the saddle inner and outer shells to form a closed volume.

28. Inner post inset curve forms the edge of cavity known as the inner post inset.

29. Outer post inset curve borders the cavity called the outer post inset.

30. Post upper cutout is the part of the saddle outer shell cut out by the outer post inset curve.

31. Post lower cutout is that part cut out by the lower post inset curve.

32. Upper post perimeter curve.

33. Lower post perimeter curve.

34. Post upper surface.

35. Post lower surface.

36. Post connecting strip joins the post upper and post lower to form the post.

37. The post—used to secure the band to the pick saddle.

38. Post inset connecting strip.

39. Post assembly.

40. Overlap area of the post with the post inset connecting strip.

41. Pick element inset curve.

42. "Zero angle" or "very small" profile angle from side view of thumb

43. "Small profile" angle of thumb

44. "Medium profile" angle of thumb

45. "High profile" angle of thumb

46. Upper encroachment boundary

47. Right hand thumb pick, top view

48. Mirror

49. Left hand pick is the mirror image of a right hand pick.

50. Minimum width between the two opposing post inset longitudinal wall at the point of the maximum width of the post.

51. Maximum width of the post.

52. Wall thickness of pick saddle

53. Flexibility of pick saddle

54. Pick element connecting edge is where the pick element attaches to the pick element inset edge on the outer surface of the pick saddle.

55. Pick element inset edge where the pick element will attach to the saddle outer surface.

56. The two post longitudinal walls determines the width of the post.

57. Opposing post inset longitudinal walls form the opening of the post inset along the length of the post.

58. Pick element upper surface.

59. Pick element lower surface.

60. Origin point

61. Longitudinal line or longitudinal axis, also called the line of symmetry and used to locate the longitudinal plane of symmetry

62. Proximal post boundary points mark the proximal boundary of the post longitudinal walls which are part of the post connecting strip.

63. Proximal post inset boundary points mark the proximal boundary of the post inset longitudinal walls and are part of the post inset connecting strip.

64. Distal post boundary points mark the distal boundary of the post longitudinal walls.

65. Distal post inset boundary points mark the distal boundary of the post inset longitudinal walls.

66. Planes perpendicular to the longitudinal axis, also called cross-sectional planes.

67. Cross-sectional slice; the result of the intersection of a cross-sectional plane with the pick saddle.

68. Longitudinal plane of symmetry

69. Elastic band

70. Portion of minimum width of elastic band.

71. Portion of maximum width of elastic band.

72. Thickness of the elastic band

73. Width of the post plus twice the thickness of the elastic band

74. Pick element of the finger pick of this invention.

75. Wider portion of pick element for a right hand finger on the lateral side of the finger.

76. Narrower portion of pick element for a right hand finger on the medial side of the finger.

77. Direction of travel of a string of a stringed musical instrument across the pick element of a right hand finger pick of this invention.

78. String of a stringed musical instrument.

We claim:

1. A means of equal distribution of force exerted by a picking device upon a distal digit of a human finger or thumb, said picking device being worn on said distal digit of a player of a stringed musical instrument to aid in plucking said stringed instrument, said thumb or said finger having an upper surface and a lower surface, said upper surface having contours said means of equal distribution of force comprising a pick saddle constructed of a sheet of hard material, said pick saddle covering a substantial portion of said upper surface of said distal digit and said pick saddle covering a smaller portion of said lower surface of said distal digit, said pick saddle having a functional surface, said functional surface being derived from the distal digit of a human thumb or finger, or a model thereof, or a likeness thereof, said functional surface being an actual physical surface or a virtual surface existing in digital form within a computer, said functional surface having an upper portion, said upper portion having surface contours which mimic said upper surface contours of said distal digit, said inner surface of said pick saddle having a lower portion which gradually encroaches upon said lower surface of said finger or thumb, said lower portion providing a securing means of said pick saddle to said distal digit, said pick saddle having no functional symmetry, said pick saddle having no plane of symmetry, whereby said surface features of said inner surface of said saddle are held in close contact with said surface features of said distal digit, said picking device is very comfortable to the user, does not dislodge from said distal digit of said finger or thumb during use and does not interfere with a string traveling across said lower surface of said finger or thumb while playing the strings of a stringed musical instrument.

2. A means of equal distribution of force exerted by a picking device of claim 1, said picking device having a second securing means of said pick saddle upon the distal digit, said second securing means is an elastic band having a portion of minimum width and a portion of maximum width, said pick saddle having an upper part, said finger or said thumb having a lower part, said portion of minimum width of said elastic band being in contact with said upper part of said pick saddle, said portion of maximum width of said elastic band being in contact with said lower part of said finger or thumb, whereby said elastic band presents a low profile to the strings of a stringed musical instrument while being played and does not interfere with said instrument strings while they move across said lower part of said finger or thumb.

3. A means of equal distribution of force exerted by a picking device of claim 2 wherein the pick saddle having a fingertip region, said pick saddle incorporates a pick element at said fingertip region of said pick saddle, said pick saddle and said pick element, together having no functional symmetry, said pick saddle and said pick element, together having no plane of symmetry, whereby said pick element is in contact with a finger or thumb of a person plucking or strumming the strings of a stringed musical instrument at a place on said finger or thumb where said finger or thumb naturally contacts said strings to be plucked or strummed, and closely approximates the sound produced by a flat pick while plucking and strumming said strings of said stringed musical instrument.

4. A means of equal distribution of force exerted by a picking device of claim 3 wherein the pick element has an upper surface, said upper surface of said pick element having a pick element connecting edge, said pick saddle having an outer surface, said pick saddle outer surface having a pick element inset edge, said upper surface of said pick element being tangent to said pick saddle outer surface at the union of said pick element connecting edge with said pick element inset edge, whereby instrument strings pass smoothly across said upper surface of said pick element.

5. A means of equal distribution of force exerted by a picking device of claim 3 wherein the pick saddle incorporates a securing means of the elastic band to said pick saddle, said securing means comprising, in combination, a post and post inset, said post having two opposing post longitudinal walls, said post inset having two opposing post inset longitudinal walls, said pick saddle having an outer surface, said elastic band being threaded around said post and held tightly in place between said post longitudinal walls and said two opposing post inset longitudinal walls, said elastic band being in contact with a substantial portion of said outer surface of said pick saddle, whereby said elastic band holds said pick saddle securely in place while in use, said post presents a low profile to strings of a stringed instrument while being played, said post and post inset do not present a sharp surface upon which said elastic band will tear, whereby extending the useful life of said elastic band, and said post allows a quick means of replacing said elastic band when said elastic band becomes worn out.

6. A post, a post inset, a pick saddle, and an elastic band of claim 5, said post having a cross-sectional shape and a distal portion, said distal portion having a maximum width, said post inset having a minimum width, the pick saddle having an outer surface, the elastic band having a thickness, said maximum width of said distal portion of said post increased by twice said thickness of said elastic band being greater than said minimum width of said post inset, whereby said post cannot raise above said outer surface of said pick saddle while in use and therefore cannot interfere with instrument strings while the instrument is played.

7. A means of equal distribution of force exerted by a picking device upon a distal digit of a human finger or thumb, said picking device being worn on said distal digit of a player of a stringed musical instrument to aid in plucking said stringed instrument, said thumb or said finger having an upper surface and a lower surface, said upper surface having contours, said means of equal distribution of force comprising a pick saddle constructed of a sheet of hard material, said pick saddle covering a substantial portion of said upper surface of said distal digit and said pick saddle covering a smaller portion of said lower surface of said distal digit, said pick saddle having a functional surface, said functional surface being derived from the distal digit of a human thumb or finger, or a model thereof, or a likeness thereof, said functional surface being an actual physical surface or a virtual surface existing in digital form within a computer, said functional surface having an upper portion, said upper portion having surface contours which mimic said upper surface contours of said distal digit, said inner surface of said pick saddle having a lower portion which gradually encroaches upon said lower surface of said finger or thumb, said lower portion providing a securing means of said pick saddle to said distal digit, whereby said surface features of said inner surface of said saddle are held in close contact with said surface features of said distal digit, said picking device is very comfortable to the user, does not dislodge from said distal digit of said finger or thumb during use and does not interfere with a string traveling across said lower surface of said finger or thumb while playing the strings of a stringed musical instrument.

8. A means of equal distribution of force exerted by a picking device upon a distal digit of a human finger or thumb, said picking device being worn on said distal digit of a player of a stringed musical instrument to aid in plucking said stringed instrument, said thumb or said finger having an upper surface and a lower surface, said upper surface having contours, said means of equal distribution of force comprising a pick saddle constructed of a sheet of hard material, said pick saddle covering a substantial portion of said upper surface of said distal digit and said pick saddle covering a smaller portion of said lower surface of said distal digit, said pick saddle having a functional surface, said functional surface having an upper portion, said upper portion having surface contours which mimic said upper surface contours of said distal digit, said inner surface of said pick saddle having a lower portion which gradually encroaches upon said lower surface of said finger or thumb, said lower portion providing a securing means of said pick saddle to said distal digit, said pick saddle having no functional symmetry, said pick saddle having no plane of symmetry, whereby said surface features of said inner surface of said saddle are held in close contact with said surface features of said distal digit, said picking device is very comfortable to the user, does not dislodge from said distal digit of said finger or thumb during use and does not interfere with a string traveling across said lower surface of said finger or thumb while playing the strings of a stringed musical instrument.

* * * * *